US009222714B2

(12) United States Patent
Zebuhr et al.

(10) Patent No.: US 9,222,714 B2
(45) Date of Patent: Dec. 29, 2015

(54) BEVERAGE COOLING DEVICE

(75) Inventors: William H. Zebuhr, Nashua, NH (US); David Dussault, Stoneham, MA (US)

(73) Assignee: IceColdNow, Inc., Braintree, MA (US)

( * ) Notice: Subject to any disclaimer, the term of this patent is extended or adjusted under 35 U.S.C. 154(b) by 837 days.

(21) Appl. No.: 13/444,438

(22) Filed: Apr. 11, 2012

(65) Prior Publication Data

US 2012/0312521 A1 Dec. 13, 2012

Related U.S. Application Data

(60) Provisional application No. 61/494,454, filed on Jun. 8, 2011.

(51) Int. Cl.

| | |
|---|---|
| ***F28D 7/04*** | (2006.01) |
| ***F28F 3/12*** | (2006.01) |
| ***F25D 3/08*** | (2006.01) |
| ***F28D 9/04*** | (2006.01) |

(52) U.S. Cl.

CPC .. *F25D 3/08* (2013.01); *F28D 7/04* (2013.01); *F28D 9/04* (2013.01); *F28F 3/12* (2013.01); *F28F 2280/02* (2013.01)

(58) Field of Classification Search

CPC ..... F25D 3/08; F25D 7/04; F25D 31/003; F25D 2303/08222; F25D 2303/0842; F28D 7/04; F28D 9/04; F28F 3/12; F24H 1/06; A47J 19/005; A47J 27/12; A47J 31/4407; A47G 23/04; A47G 19/2288; A47G 21/007; A47G 19/127

USPC ..... 62/293, 329, 371, 372, DIG. 11, 60, 62/337, 457.1–457.9

See application file for complete search history.

(56) References Cited

U.S. PATENT DOCUMENTS

| | | | | |
|---|---|---|---|---|
| 1,826,750 | A | 10/1931 | Demers | |
| 2,145,084 | A | 1/1939 | Hersey | |
| 2,720,193 | A * | 10/1955 | Maybach | 123/41.36 |
| 3,612,002 | A | 10/1971 | Margittai | |
| 4,163,374 | A | 8/1979 | Moore et al. | |
| 4,206,746 | A | 6/1980 | Chubb | |
| 4,599,872 | A | 7/1986 | Rist | |
| 5,613,422 | A | 3/1997 | Giuliano | |
| 2003/0066430 | A1 | 4/2003 | Bitar et al. | |
| 2005/0072180 | A1 * | 4/2005 | Lee | 62/457.3 |

OTHER PUBLICATIONS

Notification of Transmittal of The International Search Report and The Written Opinion of the International Searching Authority, or the Declaration, for corresponding PCT/US2012/033087, mailed on Nov. 15, 2012.

Notification Concerning Transmittal of International Preliminary Report on Patentability and Written Opinion, PCT/US2012/033087, "Beverage Cooling Device," date of mailing Dec. 27, 2013.

Invitation to Pay Additional Fees with a partial international search for PCT/US2012/033087 mailed Sep. 3, 2012.

* cited by examiner

*Primary Examiner* — Judy Swann
*Assistant Examiner* — Zachary R Anderegg
(74) *Attorney, Agent, or Firm* — Lawson & Weitzen LLP; Sonia K. Guterman; Michael I. Falkoff

(57) ABSTRACT

A fluid cooling apparatus includes a first cooling portion have a first series of cooling elements with first cooling surfaces. A second cooling portion can have a second series of cooling elements with second cooling surfaces. The second cooling portion can be removably nested together with the first cooling portion such that the first and second cooling surfaces of respective first and second series of cooling elements can be positioned adjacent to each other with gaps therebetween to form cooling cavities for cooling fluid introduced into the cooling cavities.

16 Claims, 24 Drawing Sheets

BEVERAGE COOLING DEVICE

RELATED APPLICATION(S)

This application claims the benefit of U.S. Provisional Application No. 61/494,454, filed on Jun. 8, 2011. The entire teachings of the above application(s) are incorporated herein by reference.

BACKGROUND

A typical method for making iced coffee is to brew hot coffee and then chill the hot coffee with ice. The drawback with such a method is that the strength of the coffee becomes diluted as the ice melts.

SUMMARY

The present invention can provide a fluid cooling device that can cool warm or hot liquids or beverages for consumption as a cool beverage.

The present invention can provide a fluid cooling apparatus including a first cooling portion have a first series of cooling elements with first cooling surfaces. A second cooling portion can have a second series of cooling elements with second cooling surfaces. The second cooling portion can be removably nested together with the first cooling portion such that the first and second cooling surfaces of respective first and second series of cooling elements can be positioned adjacent to each other with gaps therebetween to form cooling cavities for cooling fluid introduced into the cooling cavities.

In particular embodiments, the first and second series of cooling elements can be partitions that are spaced apart from each other by the cooling cavities, which can form cooling channels of uniform width between the partitions. The partitions of the first and second series of cooling elements can contain cooling media therein. The cooling media can be a substance that is capable of changing phase from a solid to at least a partial liquid, and in some embodiments can be water. The partitions of the first and second series of cooling elements can be hollow, containing the cooling media therein and a thermally conductive insert for conducting heat through the cooling media. The thermally conductive insert can include an aluminum sheet. The first and second series of cooling elements can be positioned within a liquid container into which liquid is capable of being poured and cooled in a batch. The first cooling portion can be a bottom cooling portion, and the second cooling portion can be an upper cooling portion that is nested downwardly into the bottom cooling portion such that the cooling portions are generally upright. The partitions of the first and second cooling elements can be generally circular and positioned concentrically relative to each other in alternating spaced apart fashion forming concentric annular cooling channels therebetween. The annular cooling channels can be connected to each other by passages extending through selected wall locations of the cooling elements which are generally aligned with a spout to facilitate to pouring from the container when tilted. The partitions of the first and second series of cooling elements can each have a distal end and can be formed with tapered side walls that narrow moving toward the distal end. The first and second series of cooling elements can be nested from opposite directions, and the tapered side walls of the adjacent partitions of the first and second series of cooling elements can match each other to form cooling channels having parallel side walls. The partitions of the first and second series of cooling elements can be molded from plastic. The upper cooling portion can include a top plate over which liquid is poured. The top plate can be configured for directing the liquid into a outer annular cooling channel. The top plate can be formed of thermally conductive metal, such as aluminum, and can be secured over the first series of cooling elements with an elongate thermally conductive rod that extends through a center chamber containing cooling media, thereby conducting heat through the cooling media in the center chamber. The cooling media can be contained within the hollow partitions of the cooling elements and have a thickness between side walls of the partitions such that the energy contained in the latent heat of fusion approximates the sensible energy change in the fluid to be cooled. The width of the cooling channels can range from about 0.05 to 0.1 inches.

The present invention can also provide a cooling apparatus including a liquid container into which liquid is capable of being poured and cooled in a batch. A first cooling portion can have a first series of generally annular concentric upright cooling element partitions with first cooling surfaces positioned within the liquid container. A second cooling portion can have a second series of generally annular concentric upright cooling element partitions with second cooling surfaces removably nested together with the first cooling portion where the first and second series of cooling element partitions can be positioned concentrically relative to each other in alternating spaced apart fashion within the liquid container, forming concentric annular cooling channels therebetween for cooling the liquid introduced therein. The annular cooling channels can be connected to each other by passages extending through selected wall locations of the cooling elements which are generally aligned with a spout to facilitate pouring from the container when tilted.

In particular embodiments, the partitions of the first and second series of cooling elements can be formed of plastic and can be hollow, and contain a cooling media therein and a thermally conductive metallic insert for conducting heat through the cooling media.

The present invention can also provide a fluid cooling apparatus including a reservoir for receiving a liquid to be cooled. The reservoir can have a bottom with at least one reservoir outlet. A spiral heat exchanger can be positioned below the reservoir and can be fluidly connected to the at least one reservoir outlet for receiving and cooling liquid from the reservoir. The spiral heat exchanger can include at least one spiral cooling channel that continuously spirals laterally radially inwardly from an outer periphery to a radially inward location for discharging cooled liquid from the radially inward location. At least a majority of opposite lateral sides of the at least one spiral cooling channel can be laterally adjacent to at least one spiral cavity for containing cooling media for cooling the at least one spiral cooling channel.

In particular embodiments, the at least spiral cooling channel can have a generally rectangular cross section, and a height, width, top and bottom. The top of the at least one cooling channel can spiral radially inwardly along a horizontal plane. The generally rectangular cross section of the at least one spiral cooling channel can continuously increase in height moving radially inwardly in a manner where the bottom of the at least one spiral cooling channel can slope downwardly moving radially inwardly for inducing liquid flow by gravity. The cooling media can include a material that can change phase from a solid to at least a partial liquid. The latent heat of fusion of the cooling media in thermal contact with the at least one spiral cooling channel can be at least approximately equal to the sensible energy to be removed from liquid to be cooled. The cooling media in some embodiments can be water. A valve can control the flow of liquid discharged from the heat exchanger, and can control liquid temperature to be in a predetermined temperature range. The valve can be a temperature controlled valve which is controlled by the temperature of liquid to be discharged. The heat exchanger can include two spiral cooling channels that are each separately fluidly connected to a respective reservoir outlet. The two spiral cooling channels can have coils that are laterally adjacent to each other in alternating fashion. The heat exchanger can be molded from high density polyethylene in upper and lower halves that are sealed together.

The present invention can also provide a method of cooling fluid including providing a first cooling portion having a first series of cooling elements with first cooling surfaces. A second cooling portion can be included and have a second series of cooling elements with second cooling surfaces. The second cooling portion can be removably nested together with the first cooling portion such that the first and second cooling surfaces of respective first and second series of cooling elements can be positioned adjacent to each other with gaps therebetween to form cooling cavities. Fluid can be introduced into the cooling cavities and can be cooled with the first and second series of cooling elements.

In particular embodiments, the first and second series of cooling elements can be partitions that are spaced apart from each other by the cooling cavities, which can form cooling channels of uniform width between the partitions. The partitions of the first and second series of cooling elements can have cooling media therein. The cooling media can be a substance that is capable of changing phase from a solid to at least a partial liquid, and in some embodiments, can be water. The partitions of the first and second series of cooling elements can have a hollow interior, containing the cooling media therein and a thermally conductive insert for conducting heat through the cooling media. The thermally conductive insert can include an aluminum sheet. The first and second series of cooling elements can be positioned within a liquid container. Liquid can be poured into the container and cooled in a batch. The first cooling portion can be a bottom cooling portion, and the second cooling portion can be an upper cooling portion that is nested downwardly into the bottom cooling portion, such that the cooling portions are generally upright. The partitions of the first and second series of cooling elements can have a generally circular shape and can be positioned concentrically relative to each other in alternating spaced apart fashion forming concentric annular cooling channels therebetween. The annular cooling channels can be connected to each other by passages extending through selected wall locations of the cooling elements which are generally aligned with the spout to facilitate pouring from the container when tilted. The partitions of the first and second series of cooling elements can each have a distal end, and can have tapered side walls that narrow moving toward the distal end. The first and second series of cooling elements can be nested from opposite directions, and the tapered side walls of the adjacent partitions of the first and second series of cooling elements can match each other and form cooling channels having parallel side walls. The partitions of the first and second series of cooling elements can be molded from plastic. Liquid can be poured over a top plate of the upper cooling portion. The top plate can direct the liquid into an outer annular cooling channel. The top plate can be formed of thermally conductive metal, such as aluminum, and can be secured over the first series of cooling elements with an elongate thermally conductive rod that extends through a center chamber containing cooling media, thereby conducting heat through the cooling media in the center chamber. The cooling media can be contained within the hollow partitions of the cooling elements, and have a thickness between the side walls of the partitions such that the energy contained in the latent heat of fusion approximates the sensible energy change in the fluid to be cooled. The cooling channels can have a width which ranges from about 0.05 to 0.10 inches.

The present invention can also provide a method of cooling fluid including pouring liquid into a liquid container and providing a first cooling portion having a first series of generally annular concentric upright cooling element partitions with first cooling surfaces positioned within the liquid container. A second cooling portion can be provided having a second series of generally annular concentric upright cooling element partitions with second cooling surfaces. The second cooling portion can be removably nested together with the first cooling portion where the first and second series of cooling element partitions can be positioned concentrically relative to each other in alternating fashion within the liquid container, forming concentric annular cooling channels therebetween for cooling the liquid introduced therein. The annular cooling channels can be connected to each other by passages extending through selected wall locations of the cooling elements which are generally aligned with a spout to facilitate pouring from the container when tilted.

In particular embodiments, the partitions of the first and second series of cooling elements can have a hollow interior and can be formed of plastic, and contain a cooling media therein and a thermally conductive metallic insert for conducting heat through the cooling media.

The present invention can also provide a method of cooling fluid including pouring a liquid into a reservoir. The reservoir can have a bottom with at least one reservoir outlet. The liquid from the reservoir can be cooled with a spiral heat exchanger positioned below the reservoir and fluidly connected to the at least one reservoir outlet for receiving the liquid from the reservoir. The spiral heat exchanger can include at least one spiral cooling channel that continuously_spirals laterally radially inwardly from an outer periphery to a radially inward location for discharging cooled liquid from the radially inward location. At least a majority of opposite lateral sides of the at least one spiral cooling channel can be laterally adjacent to at least one spiral cavity which contains cooling media that cools the at least one spiral cooling channel.

In particular embodiments, the at least one spiral cooling channel can have a generally rectangular cross section and a height, width, top and bottom. The top of the at least one cooling channel can spiral radially inwardly along a horizontal plane. The generally rectangular cross section of the at least one spiral cooling channel can continuously increase in height moving radially inwardly in a manner where the bottom of the at least one spiral cooling channel slopes downwardly moving radially inwardly for inducing liquid flow by gravity. The cooling media can include a material that can change phase from a solid to at least a partial liquid. The latent heat of fusion of the cooling media in thermal contact with the at least one spiral cooling channel can be at least approximately equal to the sensible energy to be removed from the liquid to be cooled. The cooling media can be water. The flow of liquid discharged from the heat exchanger can be controlled with a valve, and can control liquid temperature to be at a predetermined temperature range. The valve can be a temperature controlled valve, which is controlled by the temperature of the liquid to be discharged. The heat exchanger can have two spiral cooling channels that are each separately fluidly connected to a respective reservoir outlet. The two spiral cooling channels can have coils that are laterally adjacent to each other in alternating fashion. The heat exchanger can be molded from high density polyethylene in upper and lower halves which can be sealed together.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 2:
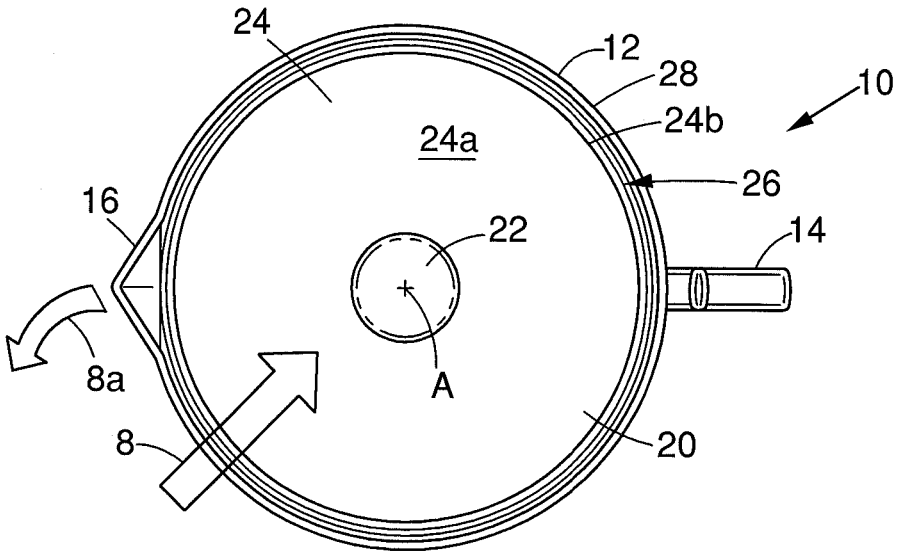
FIG. 2 is a top view of the beverage cooling device of FIG. 1.

Referring to FIGS. 1-7, an embodiment of a fluid, liquid or beverage heat exchange or cooling device 10 in the present invention can include a first, lower, bottom or base assembly 12, and a second, inner, upper, top, or insert assembly 20 which can be removably inserted into or nested downwardly together with the base assembly 12 along a common vertical axis A. The base assembly 12 can include an outer, bottom or base container 18, which can be generally round and include corrugations 17 for strength. A first, lower, bottom or base upright heat exchange or cooling portion 60 can be secured within the interior 18*a* (FIG. 9) of the outer container 18, and can include a series of heat exchange or cooling elements 66, for example four upright concentric generally annular or circular heat exchange or cooling elements 66, such as 66*a*, 66*b*, 66*c* and 66*d*, having first cooling surfaces. An additional outer circular or annular upright heat exchange or cooling element 67 can be formed by the outer wall 61 of the base cooling portion 60 and the outer container 18, and can be part of the first cooling surfaces. An upper rim member 28 having a pouring spout 16 and a handle 14 to facilitate tilting and pouring, can be also secured to the outer container 18. The insert assembly 20 can include a second, inner, upper, top or insert upright heat exchange or cooling portion 35 having a series heat exchange or cooling elements 30, for example four upright concentric generally annular or circular heat exchange or cooling elements 30*a*, 30*b*, 30*c*, and 30*d*, and can additionally have a central generally round or circular heat exchange or cooling element 42 (FIGS. 16-19), which have second cooling surfaces. A top or upper lid, plate or cover 24 can extend over the cooling elements 30 and 42. The cooling elements 30 and 42, of the insert cooling portion 35 can be nested or positioned in an adjacent and alternating manner relative to the cooling elements 66 and 67 of the base cooling portion 60, and can be or act as partitions or walls to form a series of narrow concentric generally annular or circular heat exchange or cooling channels 80 therebetween, each preferably having a cross sectional width W and height H that are generally equal, such as nine laterally concentric cooling channels, 80*a*, 80*b*, 80*c*, 80*d*, 80*e*, 80*f*, 80*g*, 80*h* and 80*i* (FIGS. 4-8). The annular cooling channels 80 can be connected together by holes, slots, openings, apertures or passages 70*a* and 70*c* extending through cooling elements 66*a*-66*d* of the base cooling portion 60, and by holes, slots, openings, apertures or passages 32*a* and 32*c* extending through cooling elements 30*a*-30*d* of insert cooling portion 35, to allow fluid or liquid 8 to flow between the cooling channels 80*a*-80*i* in a linear or aligned radial flow path 78. Passages 32*a* and 70*a* can be at or near the bottom of cooling elements 30*a*-30*d* and 66*a*-66*d*, and passages 32*c* and 70*c* can be at or near the top of cooling elements 30*a*-30*d* and 66*a*-66*d* for providing desired fluid or liquid flow circulation between the cooling channels 80. The cooling elements 30, 42, 66 and 67 can be hollow and filled with a cooling or heat exchange substance, substrate, material or media 36, which can be liquid, gel, saline, antifreeze, etc., with a freezing temperature under 32° F., as known in the art, or can be water to be nontoxic, and having a freezing temperature of about 32° F. When the cooling media 36 is water, the cooling media 36 can be a phase change material that can change phase from a solid to at least a partial liquid, or a liquid, as the liquid 8 to be cooled heats the cooling media 36, or from a liquid or partial liquid to a solid when frozen in a freezer.

In use, the cooling device 10 can be cooled in a freezer to cool the cooling elements 30, 42, 66 and 67. When water is used as the cooling media 36, the cooling media 36 can freeze in about 5-6 hours, if the insert assembly 20 is nested with the base assembly 12, or in about 1-2 hours if the insert assembly 20 and the base assembly 12 are separated. If the freezer is set at 0° F, the cooling elements 30, 42, 66 and 67 can be cooled to about 5° F and the cooling media 36 contained therein can become frozen into ice. A batch or quantity of boiling (212° F) or near boiling (about 200° F, and sometimes can be as low as about 180° F) fluid or liquid 8, for example, a beverage such as coffee or tea, can be poured into the cooling device 10, by pouring the liquid 8 over the top cover 24 of the insert assembly 20. The top cover 24 can be generally circular and have an upper surface 24*a* which slopes or curves downwardly outwardly towards the round or circular outer perimeter, rim or edge 24*b* of the cover 24, for directing the liquid 8 towards and over the rim 24*b*. The cover 24 can provide initial heat exchange or cooling to the liquid 8, and can be formed of heat exchange or heat sink material, for example aluminum. The liquid 8 can flow downwardly over the rim 24*b* in an annular flow into an annular space or gap 26 between the rim 24*b* and the upper rim member 28 of the base assembly 12, and then downwardly into an outer annular cooling channel 80*a*.

As the liquid 8 flows into and around cooling channel 80*a*, the liquid 8 also flows radially inwardly along radial flow path 78, initially through the first or lower passages 70*a* and 32*a* of cooling elements 66 and 30, to flow into and around the radially inward inner cooling channels 80*b*-80*i*. As the level or height of the liquid 8 moves upwardly within the cooling channels 80 above ribs 70*b* and 32*b*, the liquid 8 can also flow radially inward along flow path 78 through the cooling elements 66 and 30 through the second or upper passages 70*c* and 32*d*. Once the annular cooling channels 80 are filled with liquid 8, the liquid 8 is contained, formed or positioned into a series of thin or narrow circular or annular sheets 9 with a cross sectional height H and width W (FIGS. 4-8) which are concentrically located relative to each other about axis A, and in surface area contact on opposing sides with cooling elements 30, 42, 66 and 67 for heat exchange or cooling. The height H can be large in comparison to the width W to provide maximum or efficient heat exchange. The liquid 8 can undergo cooling while contained within the cooling channels 80 and in some embodiments liquid 8 can be brought down from about 200° F to 212° F, to 40° F or below, for example 35° F in about 1 to 2 minutes. The cooling media 8 when water, can change phase from a frozen solid to at least a partial liquid or liquid. Once the liquid 8 is cooled, the user can lift the cooling device 10 by gripping the handle 14 and tilting the cooling device 10 to pour the cooled fluid, liquid or beverage 8, from the spout 16 and into a cup or desired container for consumption. The passages 70*a*, 70*c*, 32*a* and 32*c* can be aligned with the spout 16 so that the batch of cooled liquid 8*a* can flow from the radially inward cooling channels 80*b*-80*i* outwardly along a radial flow path 78 that is radially aligned with spout 16 for providing smooth and efficient pouring from the cooling channels 80 out the spout 16. If desired, after liquid 8 is cooled, the insert assembly 20 can be removed from the base assembly 12 for cleaning or washing the insert 20 and base 12 assemblies. The insert assembly 20 and the base assembly 12 can be then frozen as separate parts, or can be frozen assembled.

In one embodiment, referring to FIGS. 9-12, the base cooling portion 60 can be secured within the interior 18*a* of the base container 18 (FIGS. 6, 7, 9 and 11) by screw 86 through a hole 90 in the bottom 18*b* of container 18 and hole 87 within a central tapered upwardly extending post 88 at the bottom of the base cooling portion 60. An o-ring seal 84 between the bottom of container 18 and the bottom of central post 88 around screw 86 can provide sealing. The base cooling portion 60 can be formed or molded from plastic, such as high density polyethylene, and can include a generally circular outer container wall 61, that surrounds hollow generally circular or annular cooling elements 66*a*-66*d*, which are concentrically positioned and separated from each other by generally circular or annular tapered or angled cavities, gaps or spaces 68. The cooling elements 66*a*-66*d* can have tapered or angled radially inner and outer generally circular side walls 82 and generally circular or annular upper or distal ends or tips 72 which define generally circular or annular hollow tapered cavities, gaps or spaces 83 within the cooling elements 66*a*-66*d*. The cooling elements 66 can narrow moving upwardly towards distal ends 72, and the spaces 68 can widen moving upwardly towards distal ends 72. The side walls 82 can form first or base cooling surfaces or areas. Outer wall 61 can also be tapered outwardly moving upwardly, and can be part of the first or base cooling surfaces, as part of cooling element 67. The innermost annular cooling element 66*d* can surround a generally circular cavity 76, and the central post 88 located at the bottom. The outer wall 61 and the side walls 82 of the cooling elements 66*a*-66*d* can be connected together by a bottom connecting wall 92 which can have a series of concentric generally circular or annular bottom wall portions 92*a* extending therebetween (FIGS. 10-12), which can be connected together by connecting wall segments 92*b* (FIG. 12) which are aligned with slots 70*a* and 70*c*. The central post 88 is connected to the innermost cooling element 66*d* and can act as the bottom wall inside of the cooling element 66*d*.

The cooling elements 66 can each contain the cooling media 36 within the cavities 83 between the side walls 82, and can also include a thermally conductive insert 38 which can be a sheet of thermally conductive metal that is generally annular in shape and corrugated to increase surface area. The conductive insert 38 can conduct heat (or cold) through the cooling media 36 to evenly spread heat (or cold) throughout the cooling media 36 within each cooling element 66 so that the cooling elements 66 can be evenly chilled in a freezer, and when cooling a liquid 8 during use, to exchange heat with the liquid 8 within channels 80 evenly. When water is used as the cooling media 36, which can have a freezing temperature of 32° F., the conductive insert 38 can allow the water to freeze and thaw more evenly, and can prevent or reduce the formation of thermal ice dams developing within cavities 83 which can cause uneven heat exchange and performance.

Figure 10:
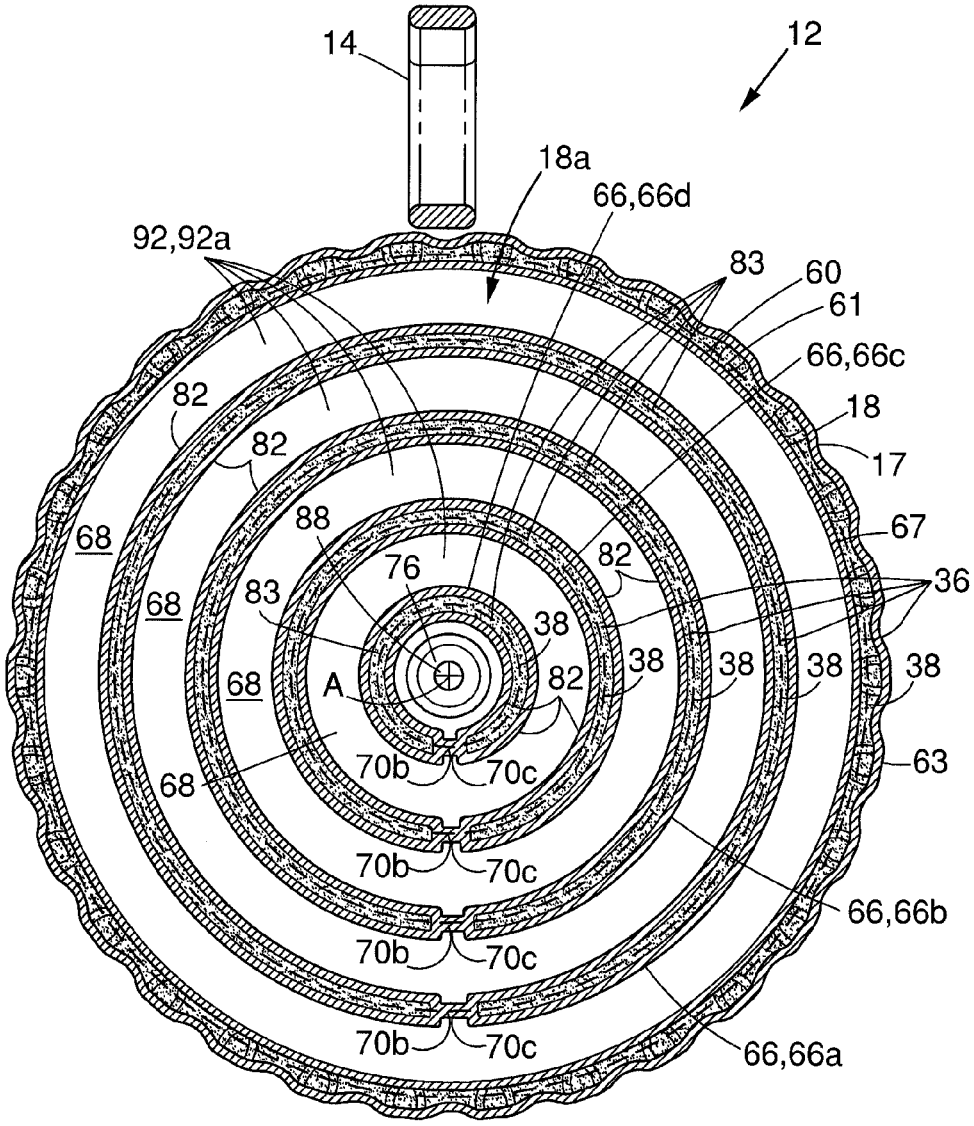
FIG. 10 is a cross sectional view of the lower assembly of FIG. 9, looking downwardly.
Figure 11:
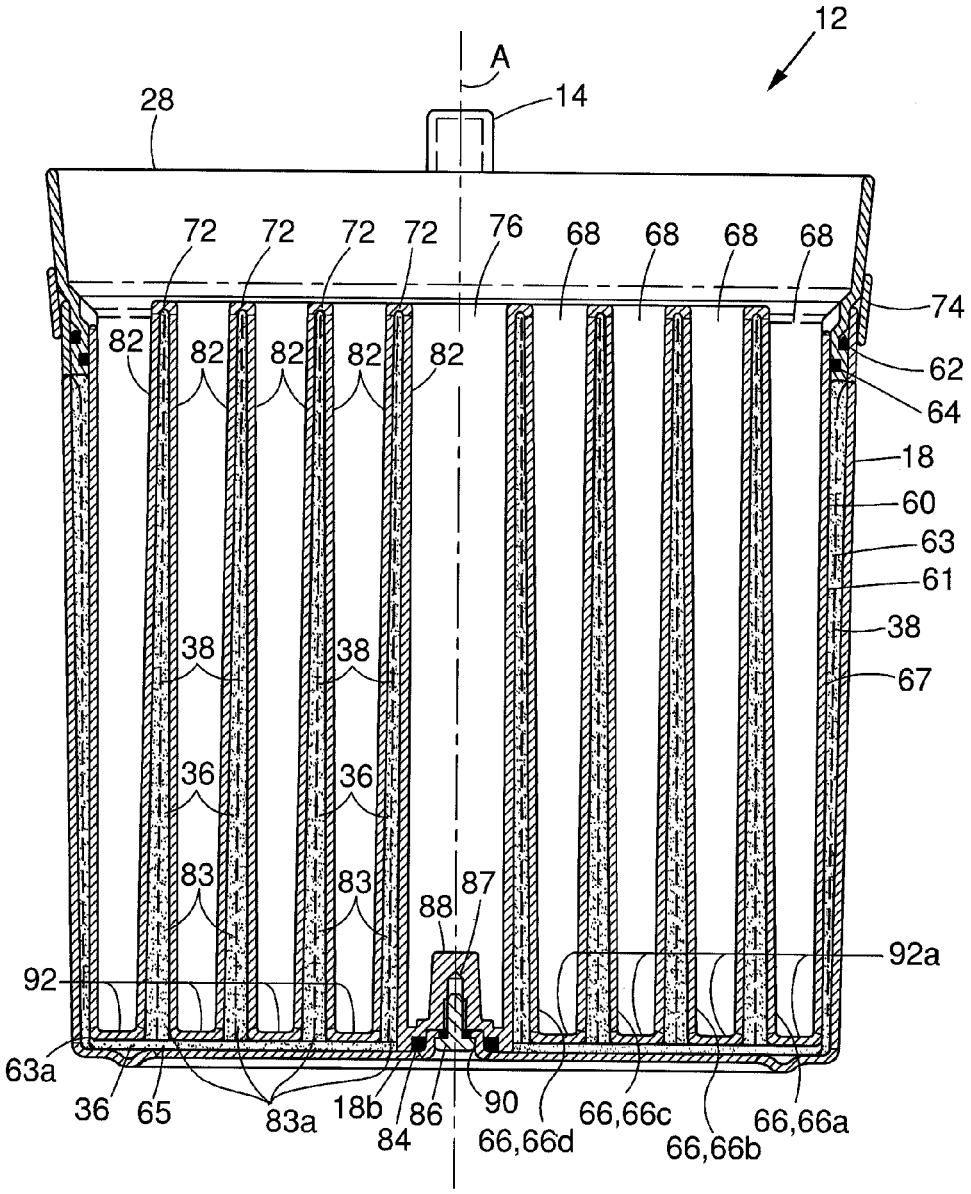
FIG. 11 is a side sectional view of the lower assembly of FIG. 9.
Figure 12:
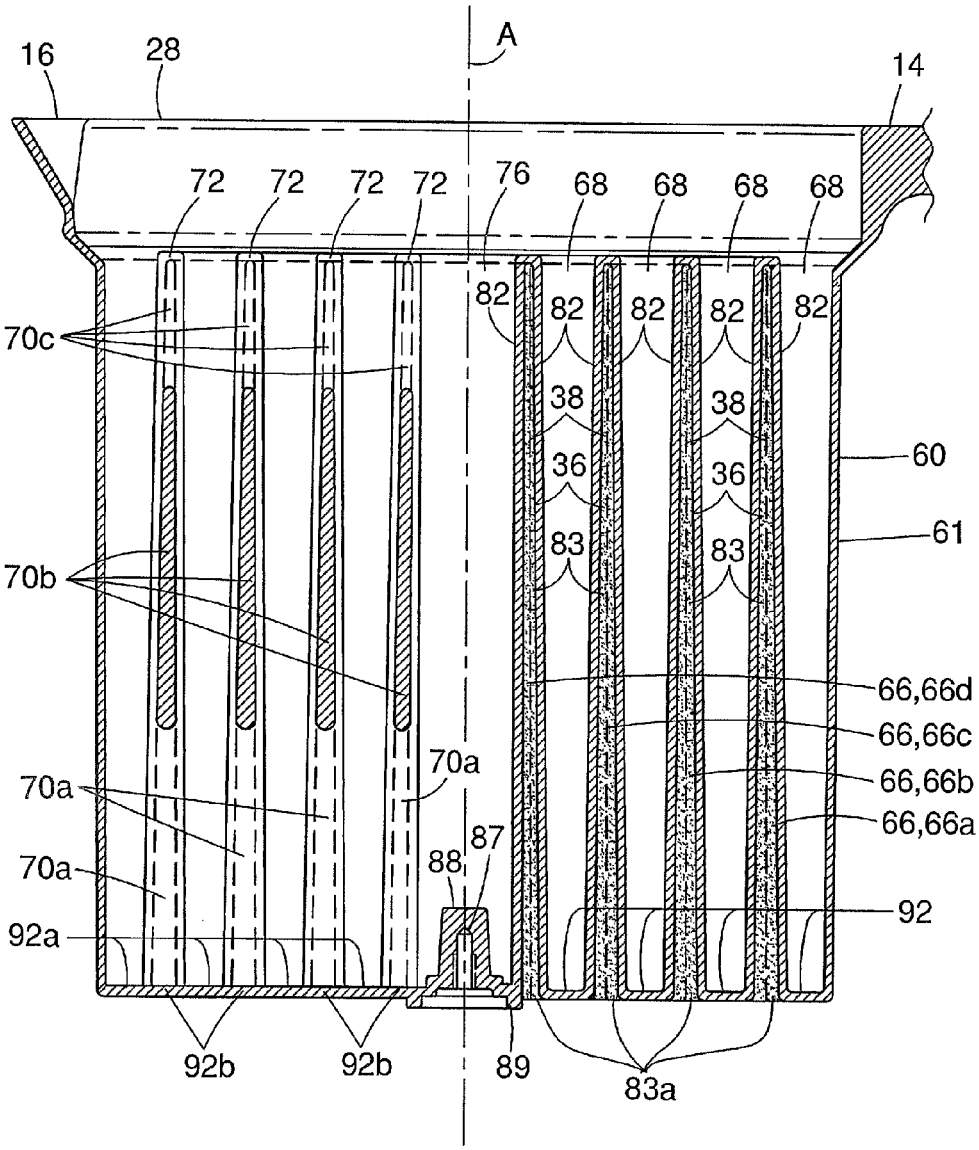
FIG. 12 is a side sectional view through an embodiment of a lower or bottom cooling portion.

The upper rim of the outer container wall 61 of the base cooling portion 60 can be sealed to the upper rim of the base container 18 by o-ring seals 62 and 64, and an outer band or ring 74 can be fitted over exterior surfaces of upper rim member 28 and the upper rim of the base container 18 to secure the upper rim member 28 to the base container 18. The outer container wall 61 can be spaced apart from the base container 18 to form a generally circular or annular cavity 63 around the outer container wall 61 which can also contain cooling media 36 and an annular conductive insert 38 therein whereby the outer container wall 61 and base container 18 can form a generally circular annular cooling element 67. The bottom of cavities 83 and 63 can have generally circular or annular openings 83*a* and 63*a* (FIGS. 11 and 12) for filling with cooling media 36 and conductive inserts 38. The bottom wall 92 of base cooling portion 60, and outer container 61, can be positioned above the bottom 18*b* of container 18 by a protrusion or annular ridge 89 (FIG. 12) to form a gap 65 (FIG. 11) therebetween which can contain cooling media 36. The gap 65 can connect the cavities 83 together and with the cavity 63 to facilitate filling with cooling media 36 and allow cooling media 36 therein to expand and contract. The slots 70*a* and 70*c* can be located at the bottom and top of cooling elements 66 inline with each other and spout 16. A structural rib 70*b* can be positioned midway up the cooling elements 66 to separate the slots 70*a* and 70*c* from each other and also provide structural strength to the cooling elements 66 (FIGS. 10 and 12). In some embodiments, the sidewalls 82 of the cooling elements 66 and the outer wall 61 can be made with corrugations to increase strength and/or surface area, or can have a series of flats, but can still be considered generally circular or annular.

Figure 13:
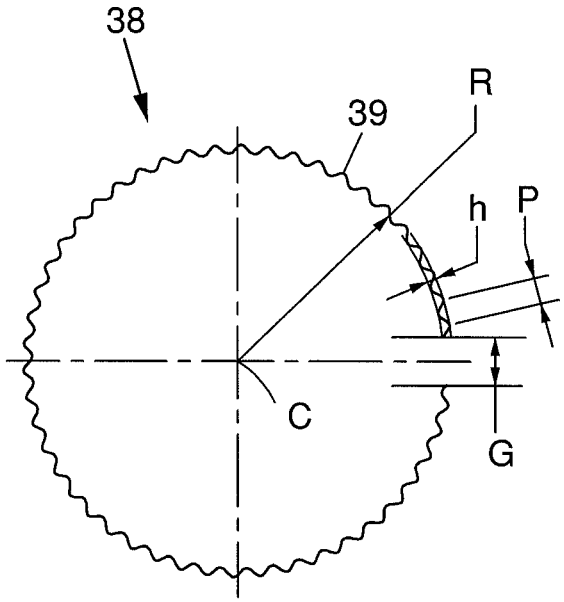
FIG. 13 is an end view of an embodiment of a thermally conductive insert.
Figure 14:
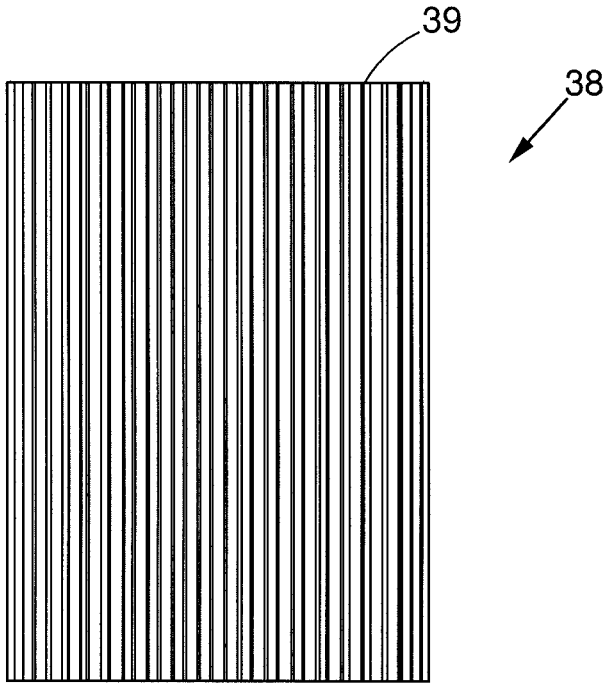
FIG. 14 is a side view of the thermally conductive insert of FIG. 13.

Referring to FIGS. 13 and 14, in one embodiment, the conductive inserts 38 can be formed of a conductive sheet of metal, such as aluminum or copper, having a series of corrugations 39. The corrugations 39 can be spaced apart with a pitch P, and have a height h, and extend parallel to the central axis C. Each conductive insert 38 within cooling elements 66*a*-66*d* and cavity 67 can have a different radius R in order to fit within the corresponding cavity 83 or 67. The conductive inserts 38 within cooling elements 66 can have a gap G to accommodate or fit around the slots 70*a* and 70*c* and ribs 70*b* (FIG. 10).

Figure 15:
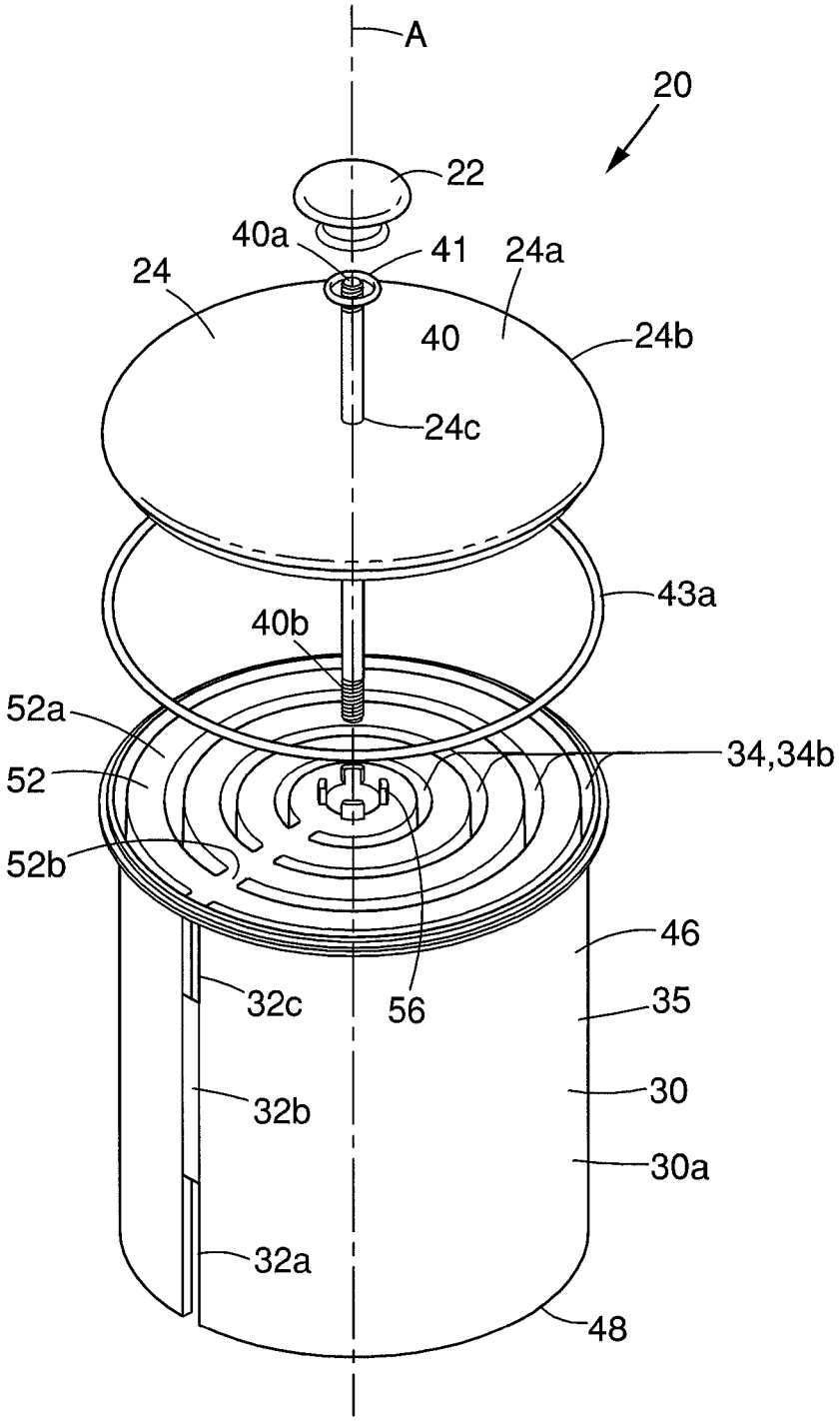
FIG. 15 is an exploded view of an embodiment of an upper assembly.
Figure 16:
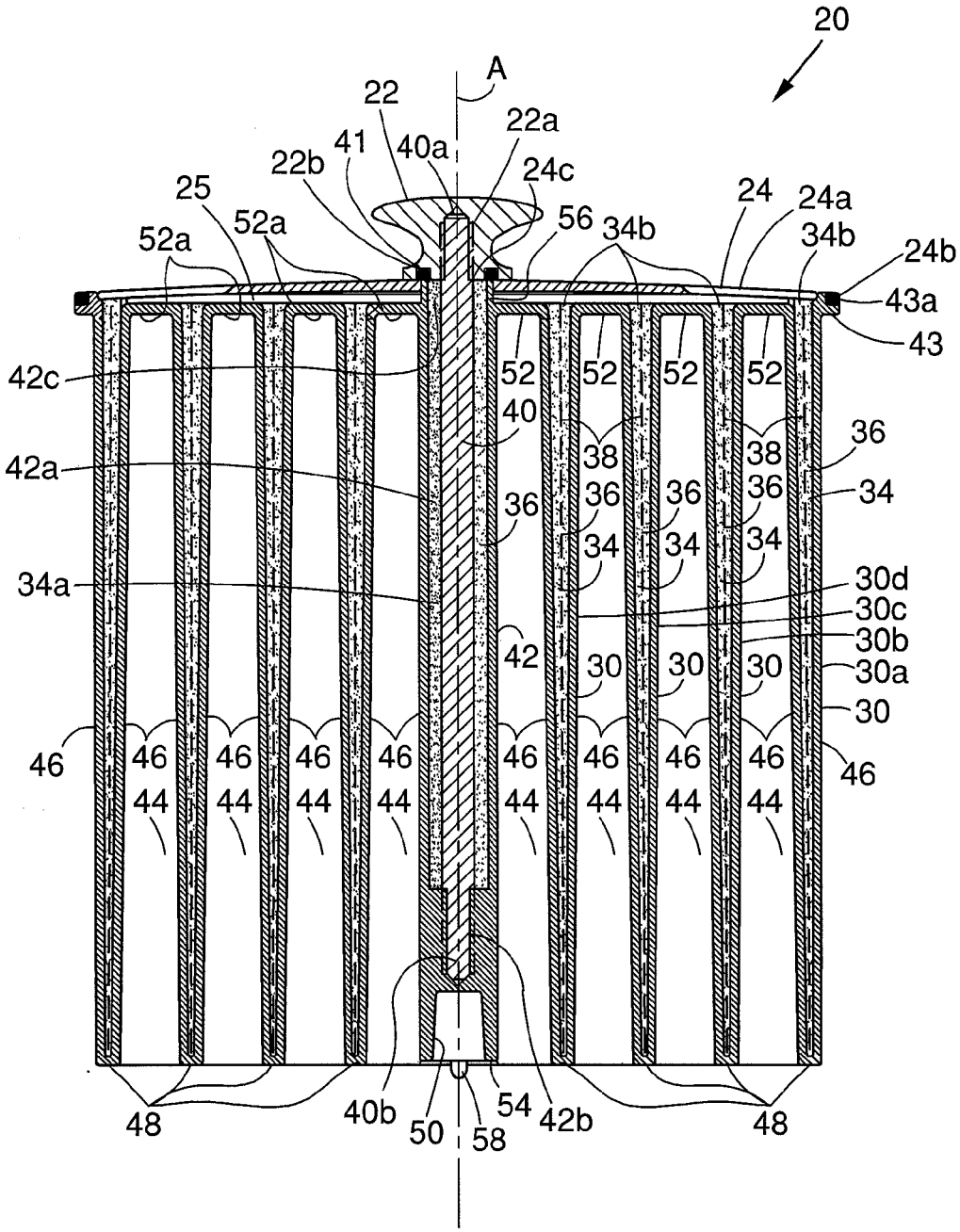
FIG. 16 is a side sectional view of the upper assembly of FIG. 15.

Referring to FIGS. 15-19, in one embodiment, the insert cooling portion 35 of insert assembly 20 can be formed or molded from plastic, such as high density polyethylene, and can have a top or upper connecting wall 52 which connects the cooling elements 30 and 42 together, and can have a series of concentric generally circular or annular top wall portions 52*a* extending therebetween, which can be connected to each other by connecting wall segments 52*b* which are aligned with slots 32*a* and 32*c* (FIG. 15). The cooling elements 30 and 42 can be concentrically positioned and separated from each other by generally circular or annular tapered or angled cavities, gaps or spaces 44. The cooling elements 30*a*-30*d* can have tapered or angled radially inner and outer generally circular side walls 46 and generally circular or annular lower or distal ends or tips 48 which define generally circular or annular hollow tapered, cavities, gaps or spaces 34 within the cooling elements 30. The cooling elements 30 and 42 can narrow moving downwardly towards distal ends 48, and the spaces 44 can widen moving downwardly towards distal ends 48. The tapers of the cooling elements in the base cooling portion 60 and the insert cooling portion 35 can facilitate molding in a mold. The side walls 46 of cooling elements 30 and 42 can form second or insert cooling surfaces or areas. The innermost cooling element 42 can be formed from a post that extends along axis A downwardly from upper wall 52 and angles or tapers in the downward or distal direction. The upper portion can have a hollow central cavity 42*a* extending about ¾ the length of the cooling element 42, which is surrounded by a tapering or angling outer wall 46 for containing cooling media 36 therein. The bottom of the cavity 42*a* can include a threaded hole 42*b*, for securement to the threaded distal end of a rod 40, such as a thermally conductive metal insert rod (often aluminum or copper) which extends through hole 24*c* in top plate 24 and secures the top plate 24 to or over the cooling elements 30 and 42 by a knob 22 having a threaded hole 22*a*, that is tightened to a threaded proximal end 40*a* of the rod 40. The space between the rod 40 and the side wall 46 can form a generally circular or annular hollow space, cavity or gap 34*a*. The rod 40 can conduct heat (or cold) evenly through the cooling media 36 within cavity 42*a* in a similar manner to the conductive inserts 38. The bottom 54 of the cooling element 42 can include a tapered socket, hole, opening or recess 50 for engaging the tapered post 88 of the base cooling portion 60 which can center the insert cooling portion 35 of the insert assembly 20 along axis A, so that the cooling elements 30 and 42 of the insert cooling portion 35 are concentrically aligned with cooling elements 66 and 67 of the base cooling portion 60, thereby forming cooling channels 80 therebetween of uniform width. The outer wall 46 of the cooling element 42 can be circular or can have four flats as shown, which can allow for outward expansion when the cooling media 36 is water and turns into ice. In some embodiments, all of the walls 46 can have flats, or be corrugated, and still be considered generally circular or annular. Short flanges or protrusions 56 can extend upwardly from the top wall 52 to engage and space the bottom of top plate 24 above the top wall 52 to form a small gap 25 therebetween. The knob 22 can have a circular or annular recess, cavity or groove 22*b* for accepting an o-ring seal 41 for sealing the knob 22 to the upper surface 24*a* of the top plate 24. The outer rim 24*b* of the top plate 24 can be sealed to the upper wall 52 by an o-ring seal 43*a* positioned on a shoulder 43.

Figure 17:
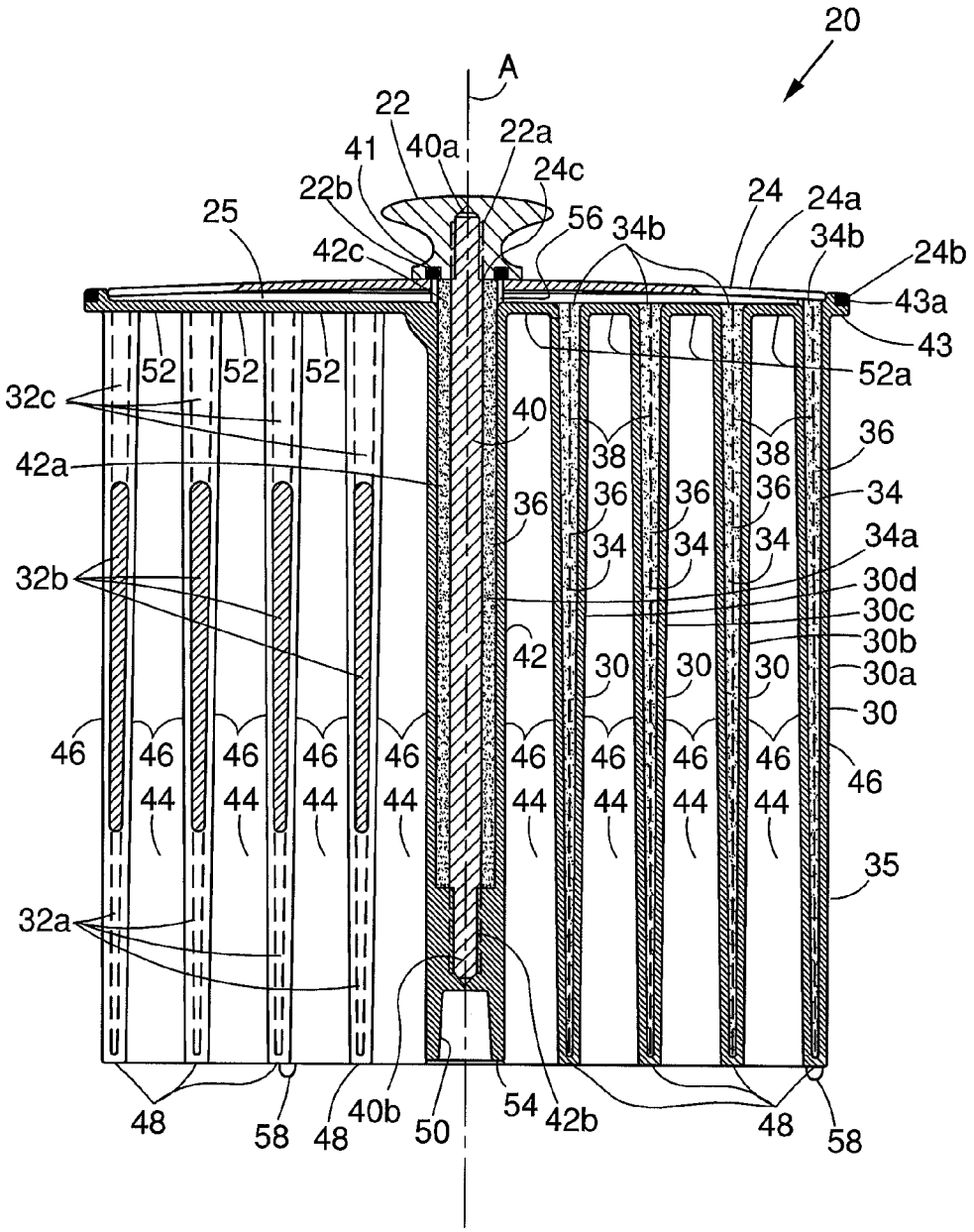
FIG. 17 is a side sectional view of the upper assembly of FIG. 15 showing passages extending through the cooling elements.
Figure 18:
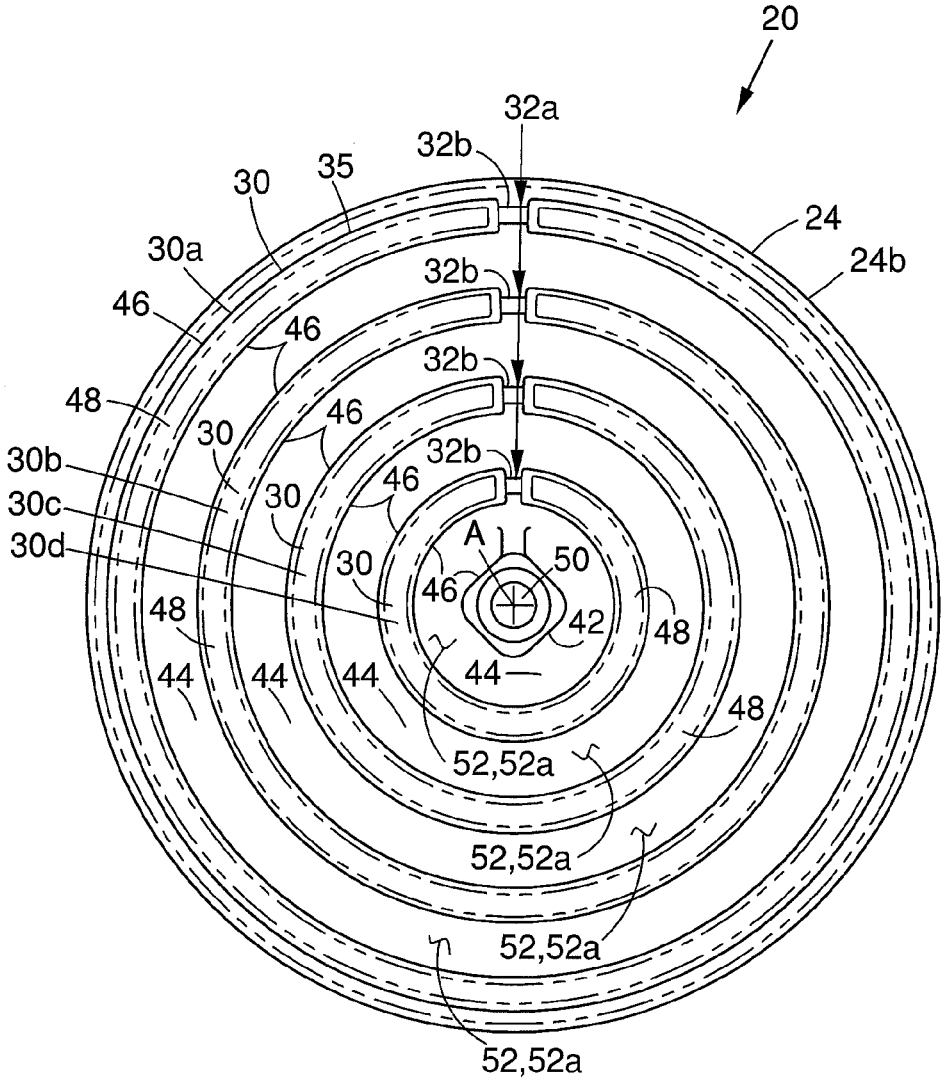
FIG. 18 is a bottom view of the upper assembly of FIG. 15.
Figure 19:
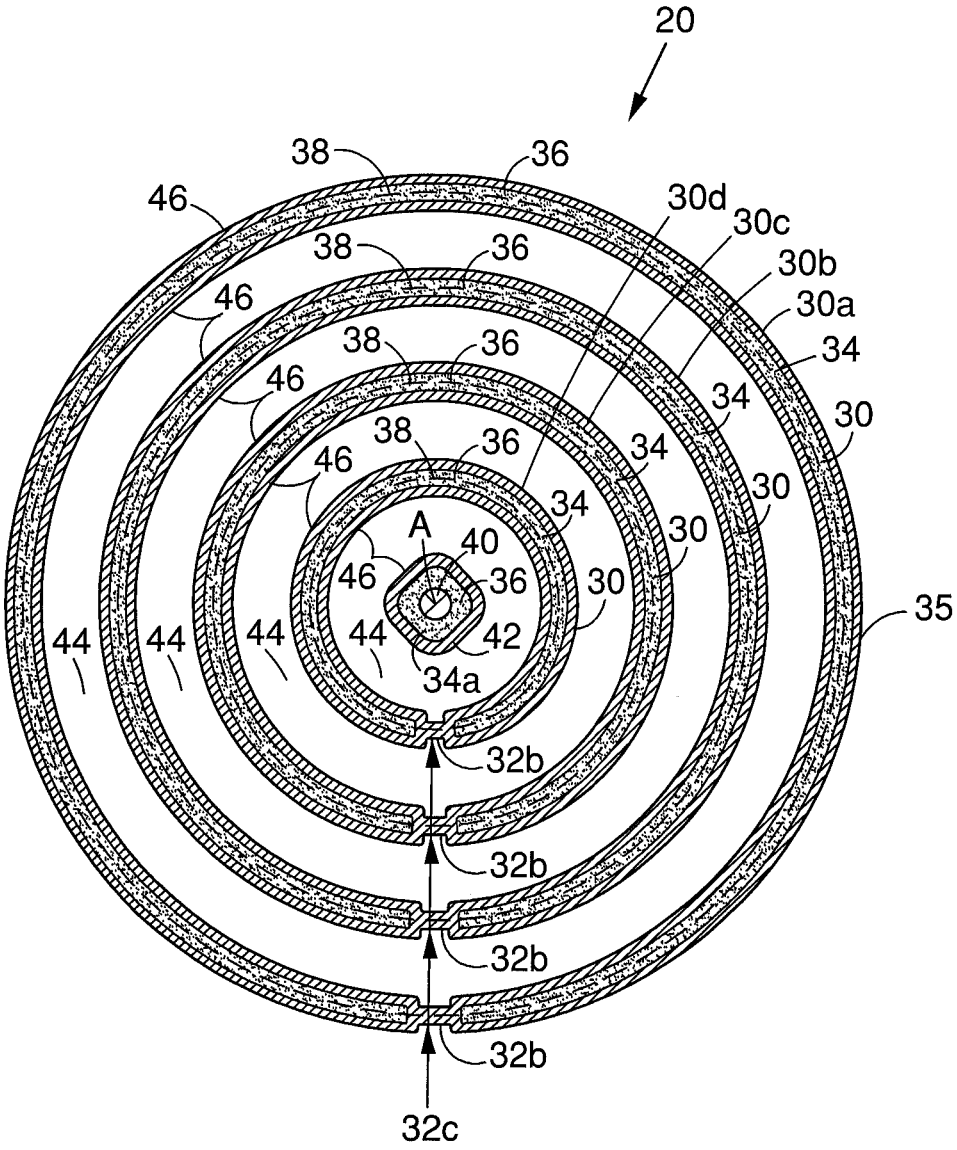
FIG. 19 is a cross sectional view of the upper assembly of FIG. 15, looking downwardly.

The cooling elements 30*a*-30*d* can concentrically surround cooling element 42 and can each contain cooling media 36 within the cavities 34 between the side walls 46, and can also include a thermally conductive insert 38 that is similar to that in cooling elements 66, for conducting heat (or cold) through the cooling media 36 to evenly spread heat (or cold) throughout the cooling media 36, as in cooling elements 66. The cooling media 36 can be the same as that within cooling elements 66. The upper, top or proximal ends of cavities 34 and 34*a* can have generally circular or annular openings 34*b* and 42*c* for filling with cooling media 36, conductive inserts 38 and conductive rod 40. The openings 34*b* and 42*c* can be connected to gap 25 to facilitate filling with cooling media 36 and can allow expansion and contraction of the cooling media 36 into the gap 25. Some of the cooling elements 30 and 42 can include a spacing protrusion 58 on the distal ends 48 and 54. When the insert cooling portion 35 is nested with the base cooling portion 60, this can keep the distal ends 48 and 54 of cooling elements 30 and 42 raised above the bottom wall 92 of the cooling portion 60 within cavities 68. The slots 32*a* and 32*c* can be located at or near the bottom and the top of cooling elements 30 inline with each other, and to be inline with the slots 70*a* and 70*c* of the cooling elements 66 and spout 16 of base assembly 12 when nested together. A structural rib 32*b* positioned midway up the cooling elements 66 can separate the slots 32*a* and 32*c* from each other and also provided structural strength to the cooling elements 30 (FIG. 17). In some embodiments, the side walls 46 of the cooling elements 30 can be made with corrugations to increase strength and/or surface area.

Figure 8:
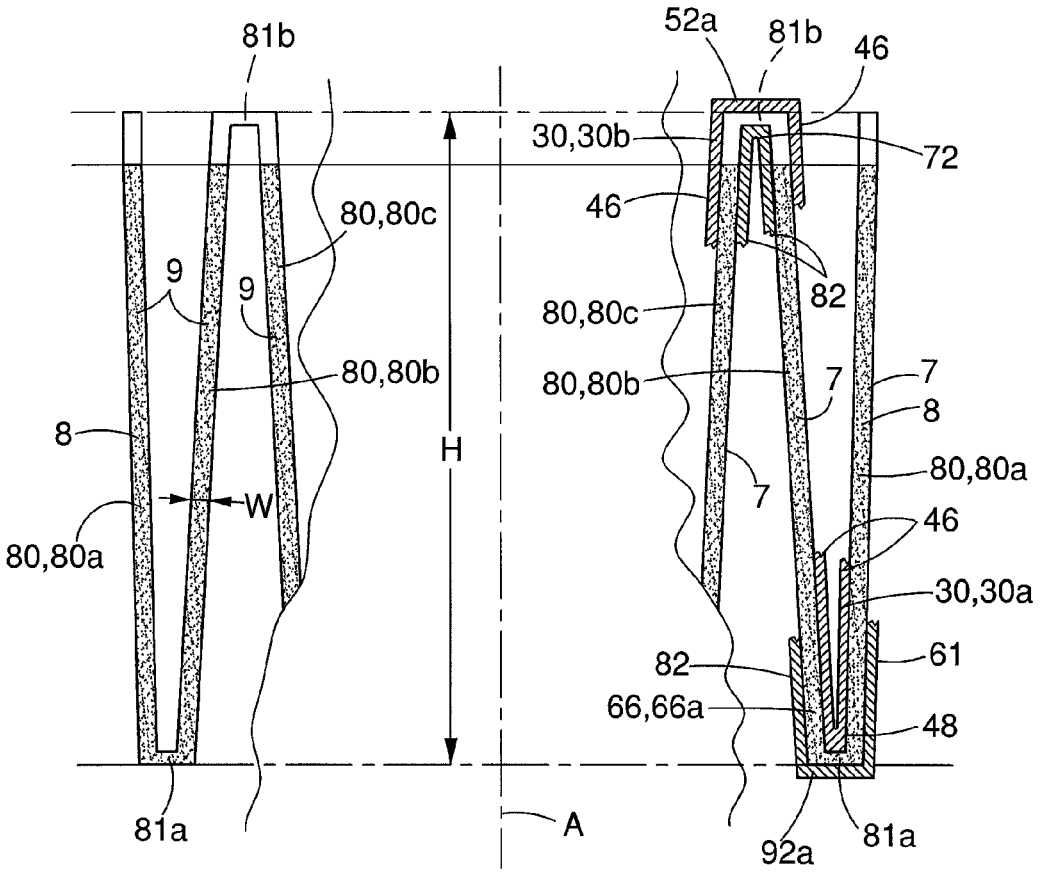
FIG. 8 is a schematic side sectional drawing of liquid within a portion of the cooling channels.
Figure 9:
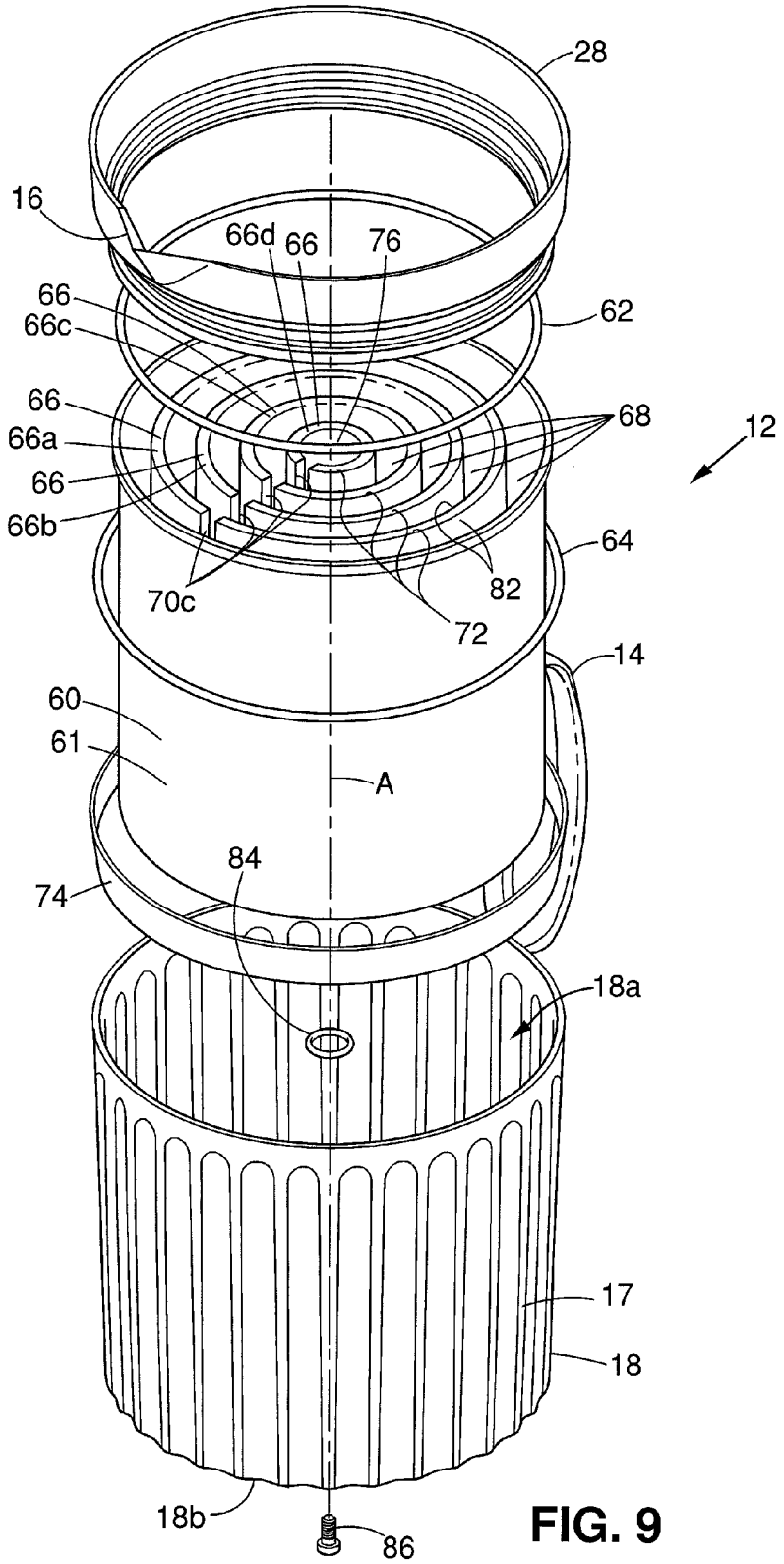
FIG. 9 is an exploded view of an embodiment of a lower assembly.

The downward taper or narrowing of the cooling elements 30 and 42 can be equal and opposite to the upward taper or narrowing of cooling elements 66 and 67 so that when the cooling elements 30 and 42 of the insert cooling portion 35 are inserted in a downward direction into base cooling portion 60 adjacent to cooling elements 66 and 67, thereby nesting from opposite directions, the tapered side walls 46 of the insert cooling portion 35 and the tapered side walls 82 and 61 of the base cooling portion 60, match or mate each other in a spaced apart parallel manner to form generally annular uniform width cooling channels 80 having uniform parallel or evenly spaced concentric side walls 46, 82 and 61, that are angled or tapered slightly relative to axis A in alternating fashion. As a result the top of the cooling channels 80 each alternately angle upwardly away and upwardly towards axis A, moving from channel 80*a* towards channel 80*i*, due to the alternately nested tapers of the cooling elements 30, 42, 66 and 67. Referring to FIG. 8, this can form concentric thin walled hollow generally truncated circular or annular cones or frustoconical shapes 7 of liquid 8 within the cooling passages 80 which alternately point or angle downwardly (for example within cooling channel 80*a*), and point or angle upwardly (for example within cooling channel 80*b*), and continuing in that manner within cooling channels 80*c*-80*i* in alternating fashion. In some embodiments, the bottom of the cooling channels 80 can be fluidly connected together by lower circular or annular passages 81*a* between the annular lower wall portions 92*a* and the distal ends 48, forming a series of generally annular frustoconical channels 80 and shapes 7 of liquid 8 that are connected together to have a generally V-shaped connected cross section. The top of the cooling channels 80 can be connected together by upper circular or annular passages 81*b* between the annular upper wall portions 52*a* and the distal ends 72 to have cross sectional connected pointed peaks, which can allow fluid communication at the peaks if the level of liquid 8 reaches that high.

In some embodiments, the base assembly 12 can be about 4½ to 5 inches in diameter, for example about 4.8 inches, and the height of the base assembly 12 extending to the top of the upper rim 28 can be about 5 to 5½ inches, for example about 5.3 inches. The outer container 18 can have an outer diameter of about 4½ to 5 inches, such as about 4.73 inches, a height of about 4¼ to 5 inches, such as about 4.6 inches and a wall thickness of about (1/32 to 1/16 inches) about 0.04 to 0.05 inches. The base cooling portion 60 can have cooling elements 66 that are about 4½ inches high and tapered moving in the direction of distal ends 72 such that the cavities 83 have a width at the proximal end or opening 83*a* about ⅛ to 3/16, or 0.136 inches, and a width at the distal end 72 of about 1/16 inches, such as about 0.061 inches. The annular gaps 68 can also taper and can be about 5/16 to ⅜ inches (such as about 0.341 inches) wide between the distal ends 72 and taper down to about ¼ to 9/32 inches (such as about 0.265 inches) at the proximal end or bottom wall 92. The side walls 82 and 61 can each be angled at about 0.50° relative to axis A, or can have a 1° included angle for a pair of walls. The side walls 82 and 61 can be about 1/32 inches or about 0.030 inches thick, the bottom wall 92 can be about 1/16 inches or about 0.060 inches thick, and the distal ends 72 can have a thickness of about 1/16 inches or about 0.060 inches. The taper can facilitate the molding process of base cooling portion 60. The conductive insert 38 can each have a radius R and a longitudinal length to fit within cavities 83 and 67, and can have a gap G of about ⅜ inches or about 0.38 inches. The corrugations 39 can have a pitch P of about ¼ inches or about 0.2 inches, and can have a height h of about 1/16 inches or about 0.05 inches. The conductive insert 38 can be formed of aluminum sheet metal about 0.002 to 0.005 inches thick.

The top plate 24 and top wall 52 of insert cooling portion 35 can have an outer diameter of about 4¼ inches (about 4.34 inches). The cooling elements 30 and 42 of insert cooling portion 35 can have a height of about 4½ inches. The spacing protrusions 58 can have a height of about 1/16 inches (about 0.060 inches). Cooling elements 30 can have side walls 46 that are about 1/32 inches thick (about 0.030 inches), and have a cavity 34 between the side walls 46 that can taper from a width of ⅛ to 3/16 inches (about 0.142 inches) at the proximal end or opening 34*b*, and narrow moving in the direction of the distal ends 48 to a width of about 1/16 inches (or about 0.067 inches). The annular gaps 44 can be about 5/16 to ⅜ inches (such as about 0.334 inches) between the distal ends 48 of the cooling elements 30 and taper down to about ¼ to 9/32 inches (such as about 0.259 inches) at the proximal end or top wall 52. The side walls 46 can each be angled at about 0.5° relative to axis A, or can have a 1° included angle for a pair of walls. The top wall 52 and distal ends 48 can have a thickness of about 1/16 inches (such as about 0.060 inches).

Referring to FIGS. 4-8, the cooling channels 80 can have a cross sectional area that is generally rectangular and about 0.05 to 0.10 inches wide (such as about 0.07 inches). The cooling media 36 contained within the cavities 34 of the cooling elements 30 and cavities 83 of cooling elements 66 can have a thickness between the side walls 46 and 82 such that the energy contained in the latent heat of fusion can approximate the sensible energy change in the liquid 8 to be cooled within cooling channels 80. The thickness of the cooling channels 80 and the cooling elements 30 and 66 can provide optimum rapid cooling of the liquid 8. The height of the cross sectional area of the cooling channels 80 can be about 4½ inches high, to provide each cooling element 30 and 66 with a large or tall heat exchange cooling surface with the liquid 8 in comparison with the width of the cooling channels 80, for example height H to width W ratio H:W, can range from about 90:1 to 45:1, and is often 64:1. Although the cooling elements 30 and 66 are tapered, each cooling channel 80 between a cooling element 30 and 66 can have a downwardly narrowing tapering cooling element 30 one side, and a matching upwardly narrowing tapering cooling element 66 on the opposite or other side, so that the combined thickness of the cooling elements 30 and 66 and cooling media 36 on opposite sides of the cooling channels 80, when added together, can add up to be a generally consistent value or amount anywhere along the height of the cooling channels 80, to provide a generally consistent cooling capability at any height. The side walls 46 and 82 of the cooling elements 30 and 66 can expand outwardly slightly to account or compensate for volume changes of the cooling media 36, such as when turning into ice. It is understood that the number, size and thickness of the cooling elements and cooling channels can vary as desired.

Figure 20:
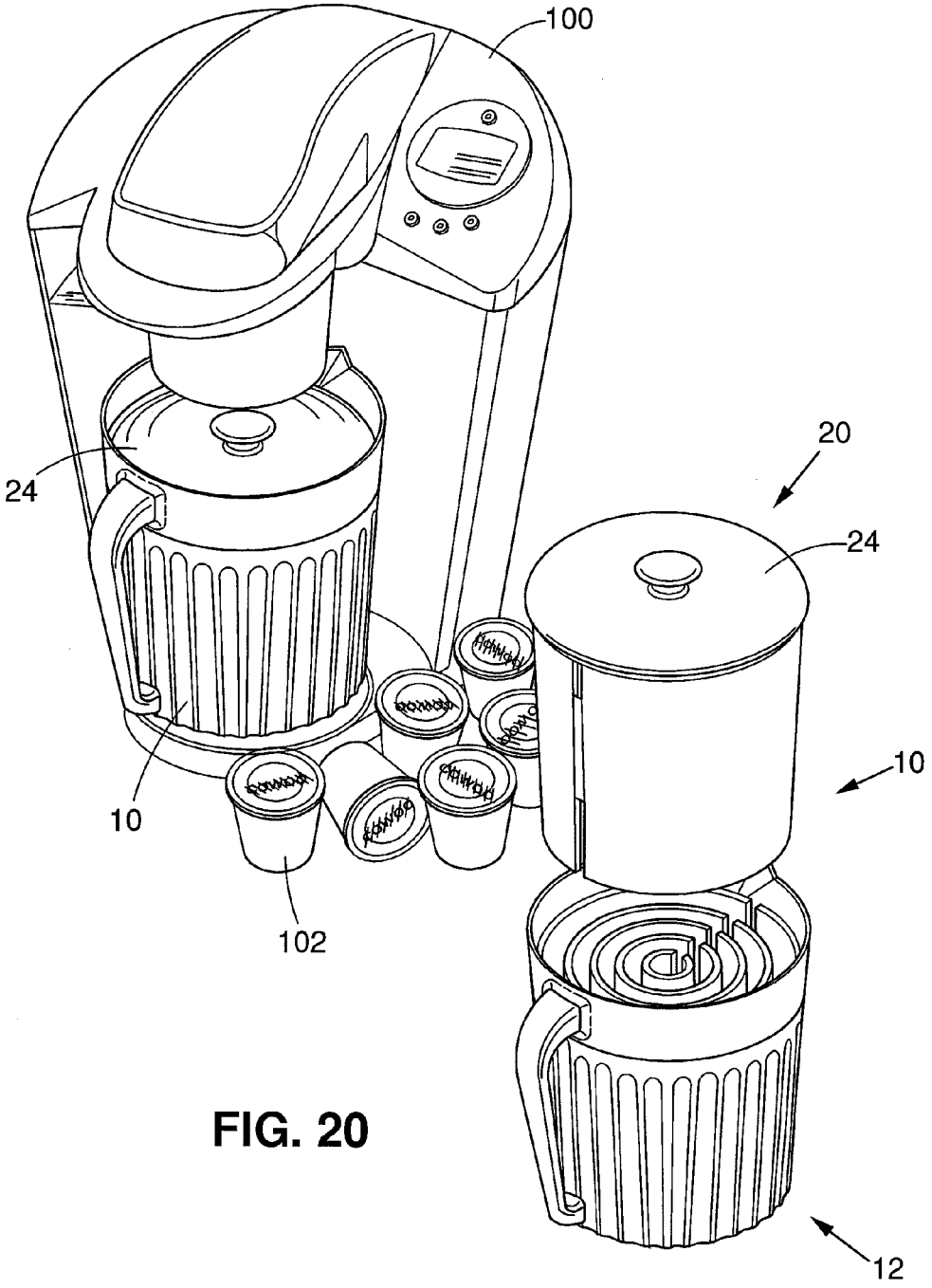
FIG. 20 is a perspective view of a beverage cooling device positioned in a coffee maker and an exploded view of another beverage cooling device.

Referring to FIG. 20, the cooling device 10 can be used in conjunction with a hot beverage maker 100, such as a coffee machine, which can brew hot coffee from packages 102 of coffee, and deliver the brewed coffee onto the top plate 24 for cooling within cooling device 10. In other embodiments, hot tea or warm juices or drinks can be cooled.

Figure 1:
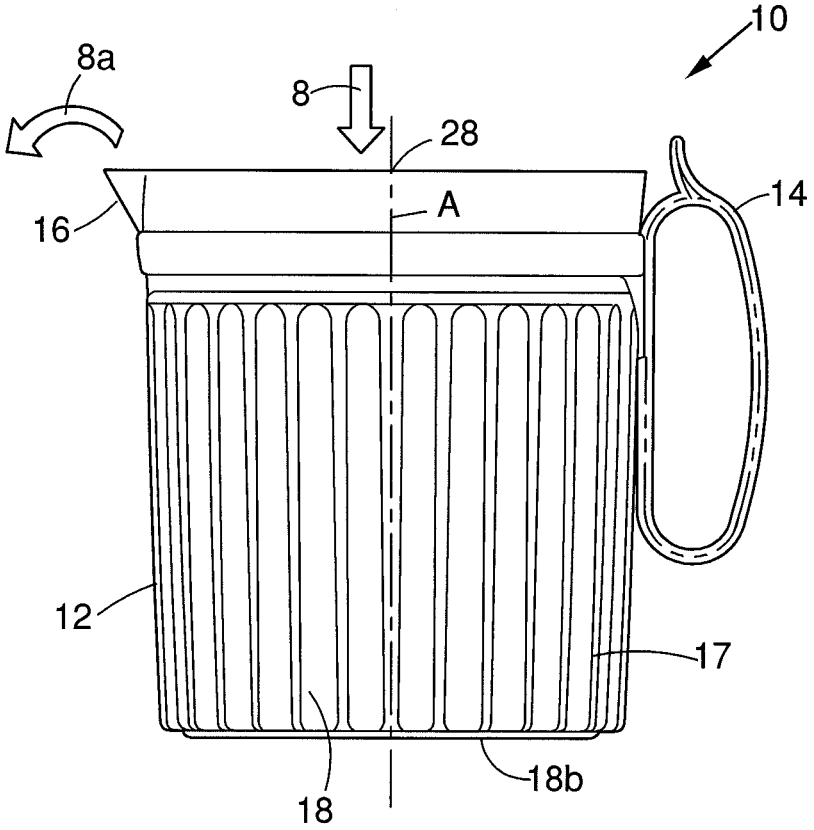
FIG. 1 is a side view of an embodiment of a beverage cooling device in the present invention.
Figure 3:
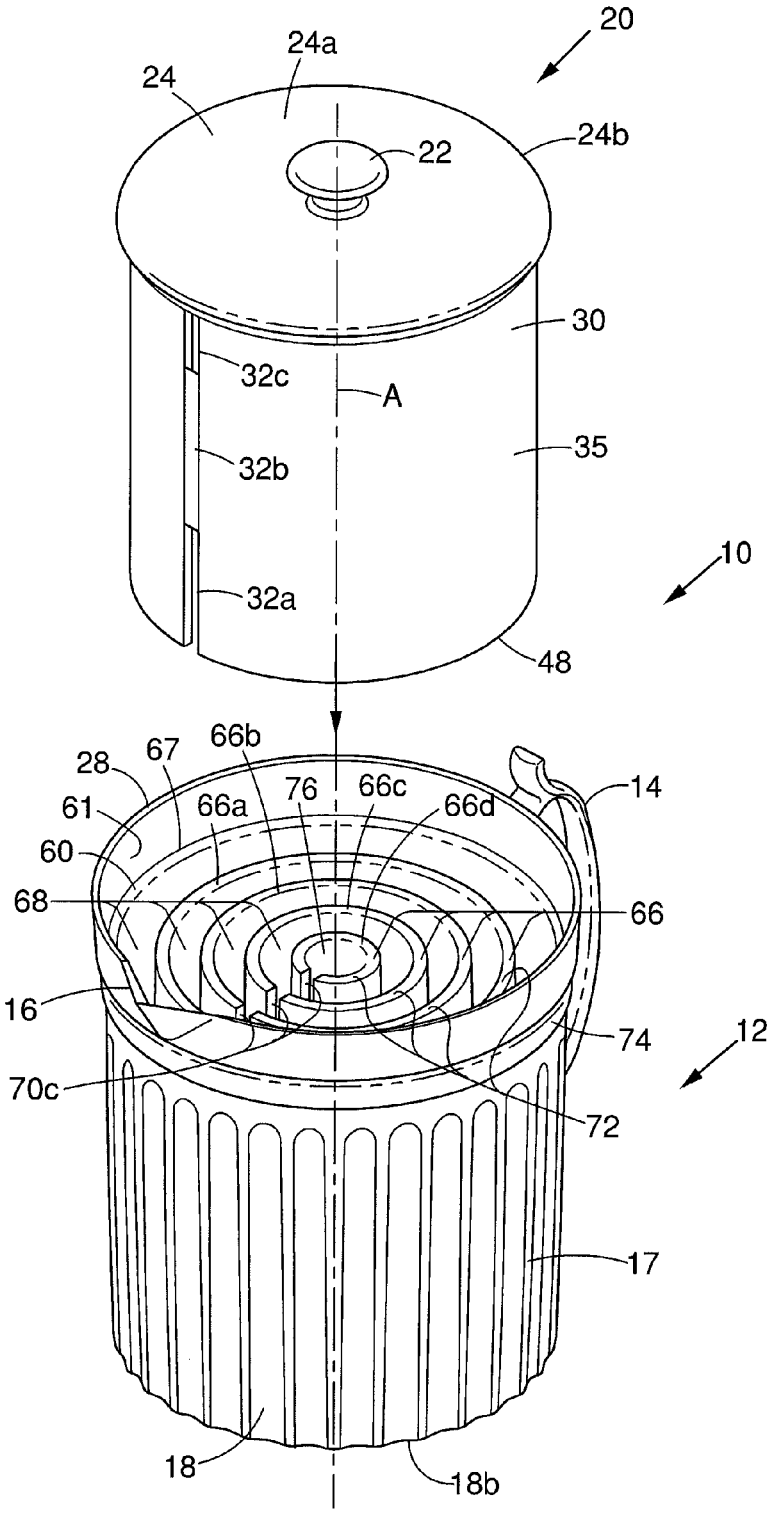
FIG. 3 is an exploded view of the beverage cooling device of FIG. 1, in which the upper and lower assemblies are shown separated from each other.
Figure 4:
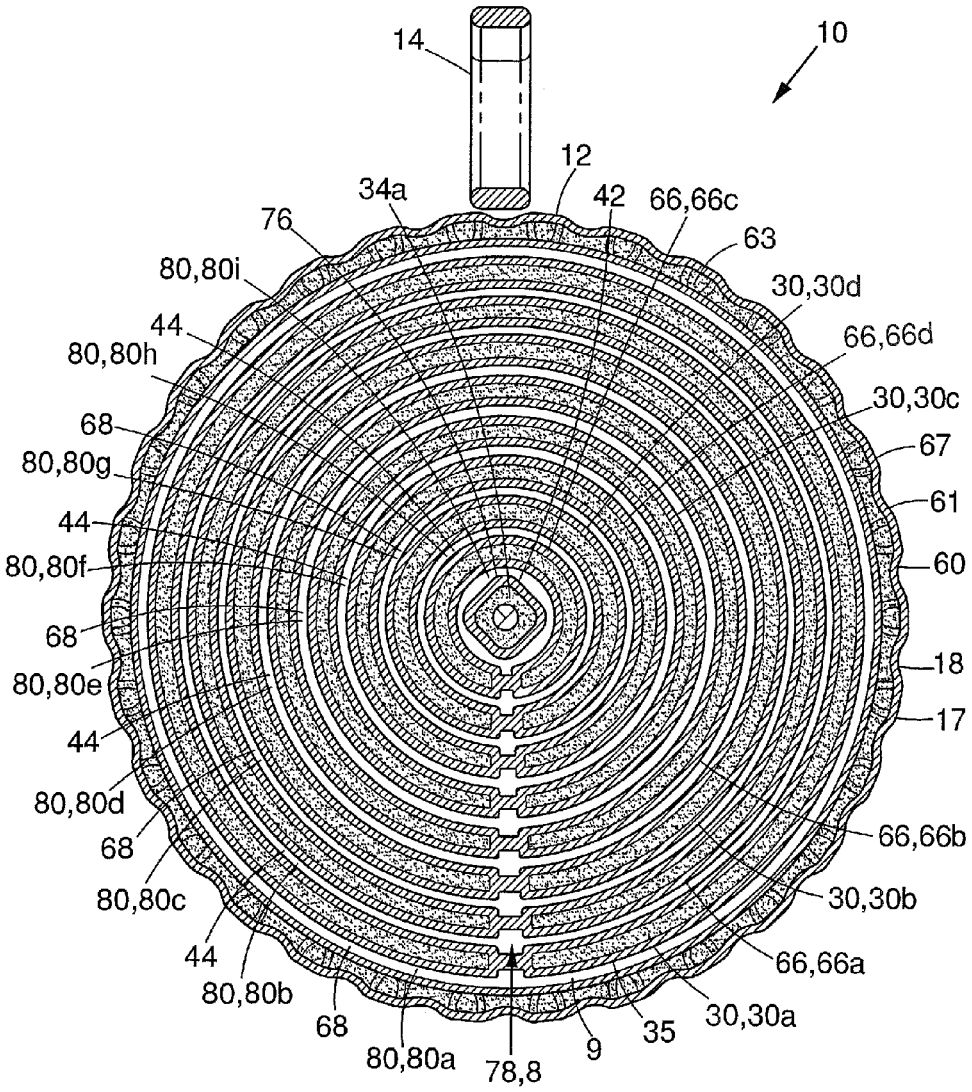
FIG. 4 is a cross sectional view of the beverage cooling device of FIG. 1, looking downwardly.
Figure 5:
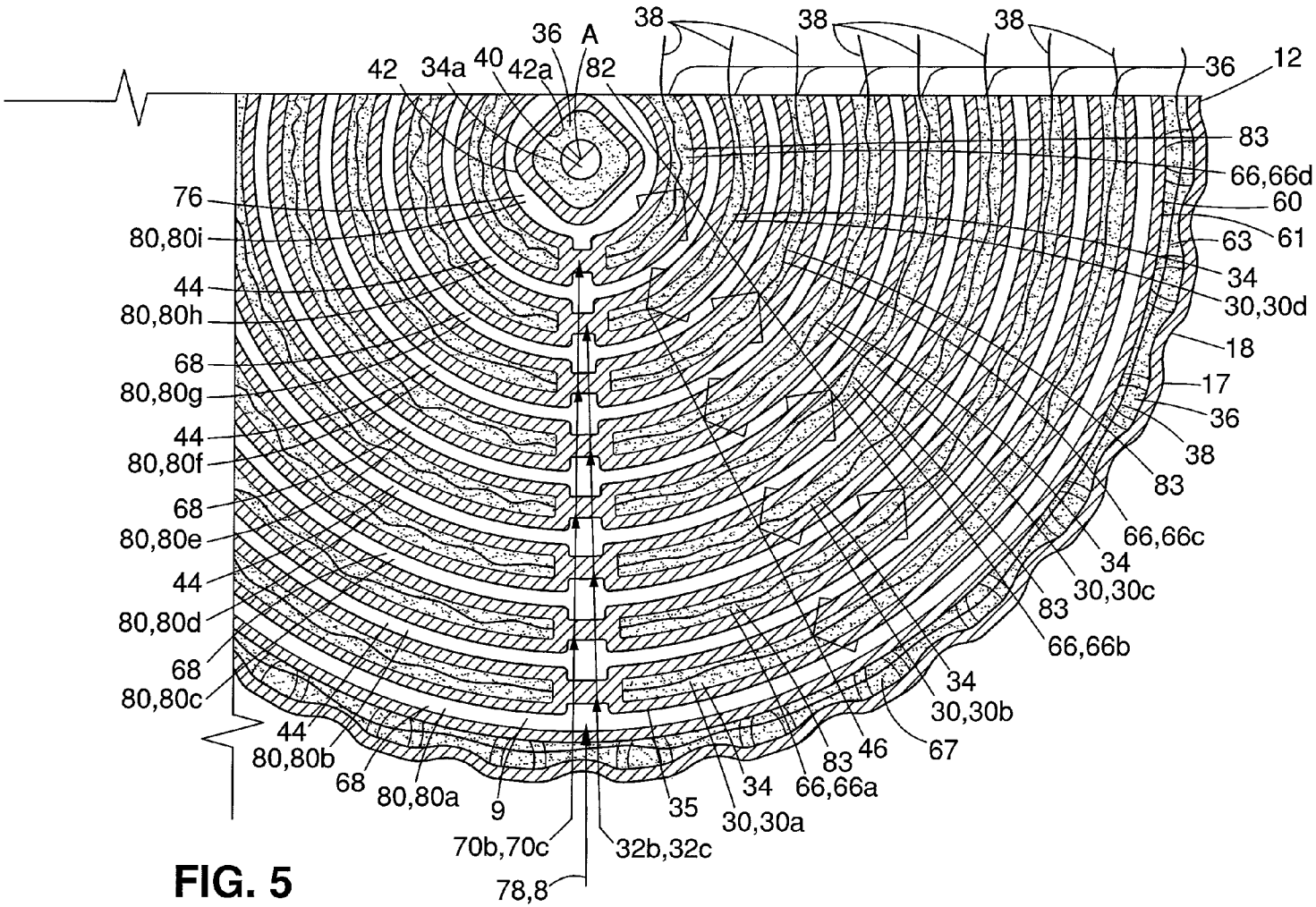
FIG. 5 is an enlarged portion of FIG. 4.
Figure 6:
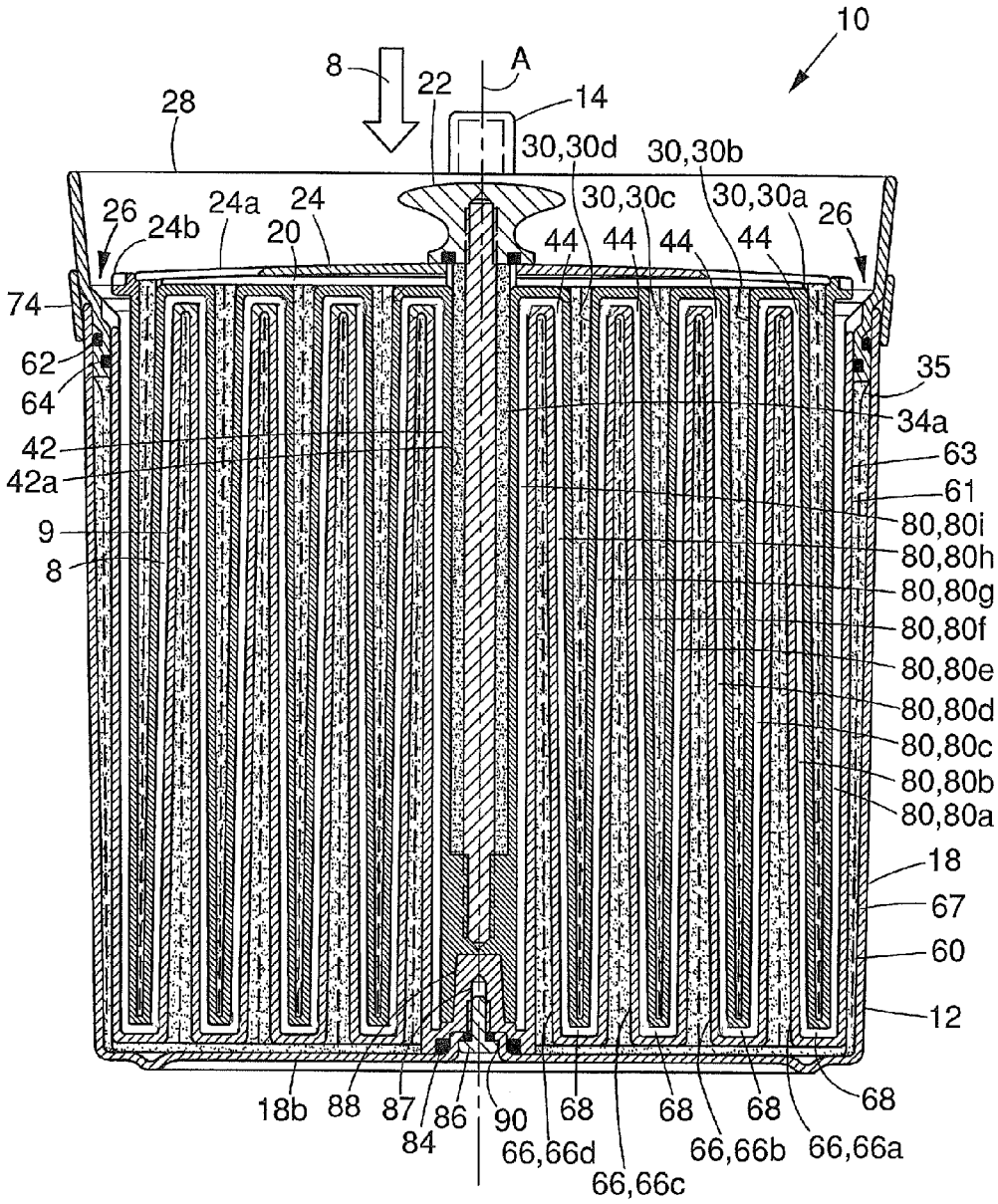
FIG. 6 is a side sectional view of the beverage cooling device of FIG. 1.
Figure 7:
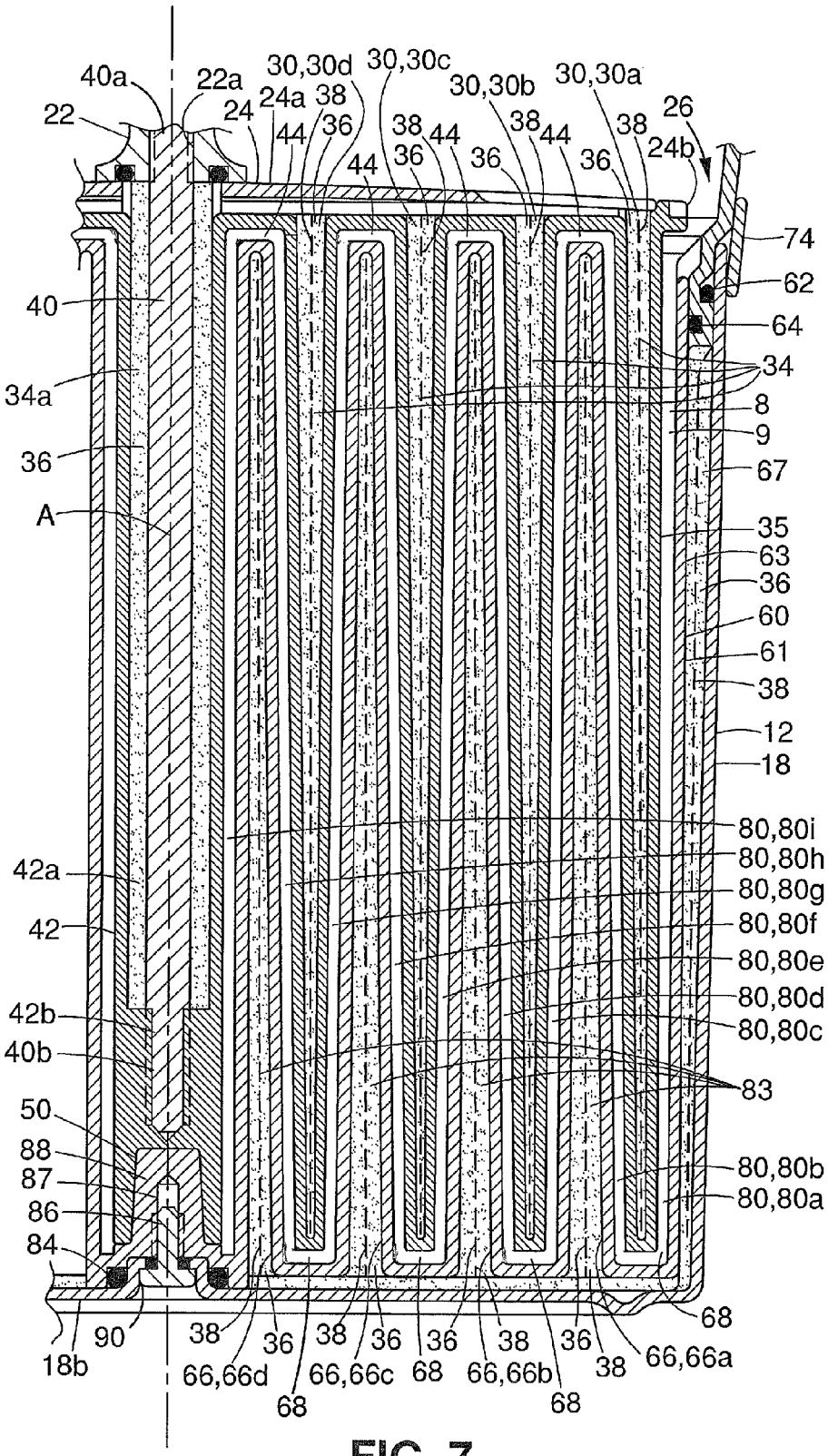
FIG. 7 is an enlarged portion of FIG. 6.
Figure 21:
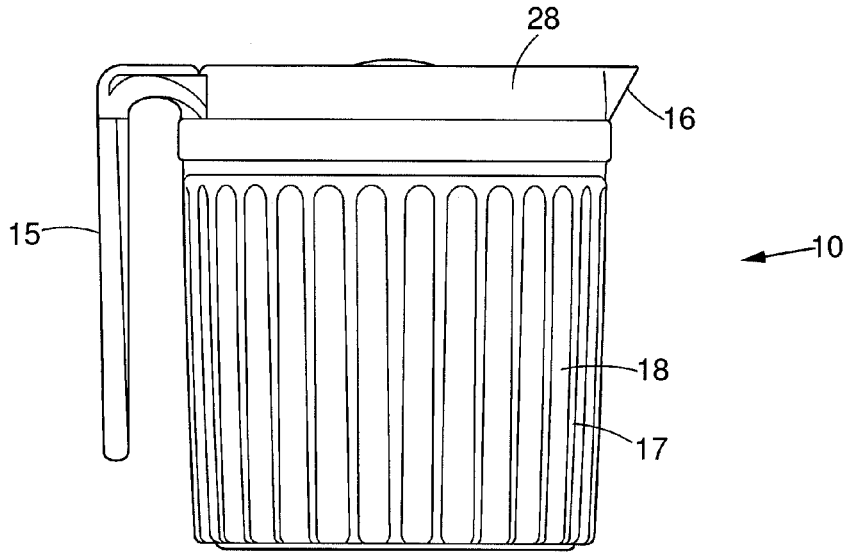
FIG. 21 is a side view of another embodiment of a beverage cooling device.

Referring to FIG. 21, the cooling device 10 can have a different handle design 15 than handle 14 seen in FIG. 1, which can have a straight gripping portion extending downwardly. In addition, other suitable handle designs can be used.

Figure 22:
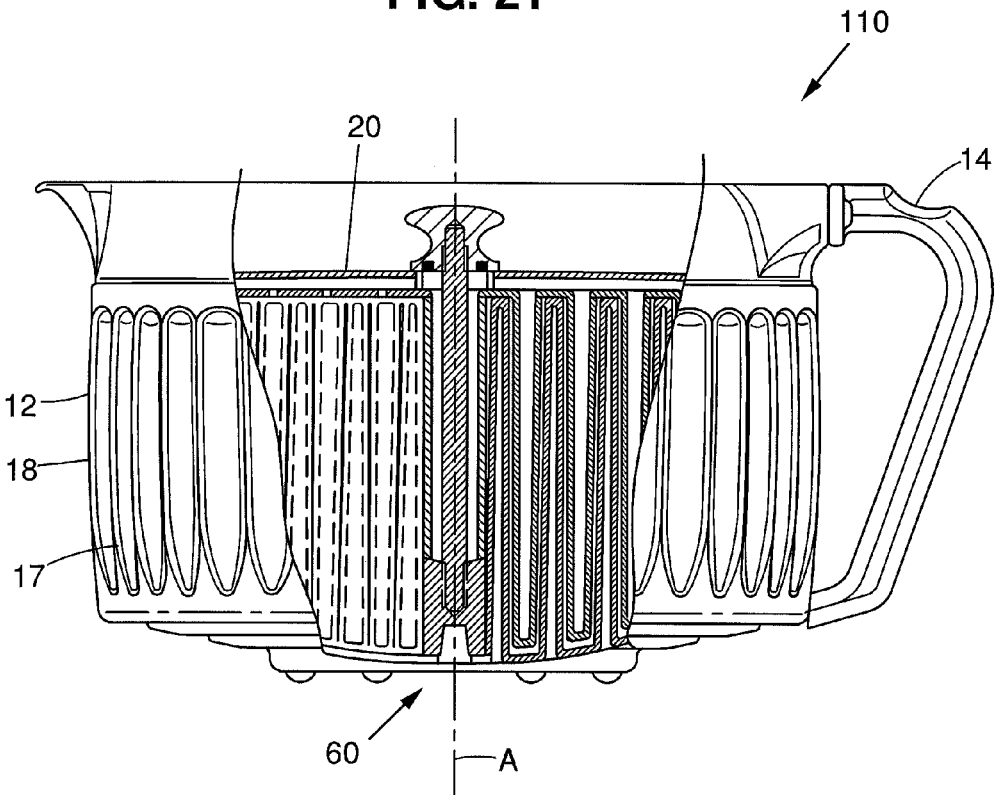
FIG. 22 is a side view of another embodiment of a beverage cooling device with portions broken away.

Referring to FIG. 22, cooling device 110 is another embodiment in the present invention, which generally differs from cooling device 10 in that the base assembly 12 and insert assembly 20 are shorter in height.

Figure 23:
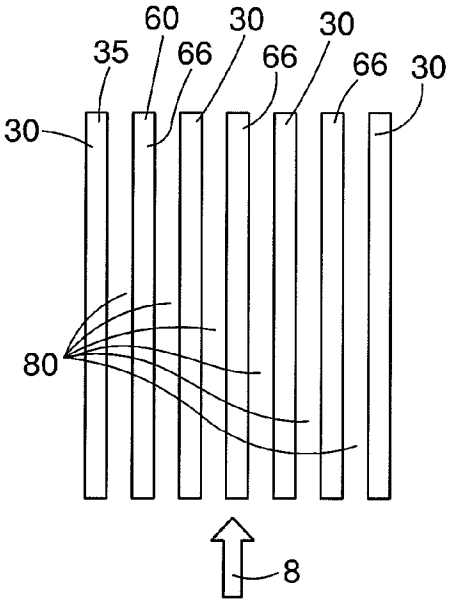
FIG. 23 is a schematic view of another embodiment of cooling elements.

Referring to FIG. 23, in some embodiments, the cooling elements 30 and 66 of insert cooling portion 35 and base cooling portion 60, can be linear or straight walls or partitions to form linear cooling channels 80 therebetween, or can include linear or straight wall portions. In addition, in some embodiments, the cooling elements 30 and 66 can have tapered side walls 46 and 82, and tapered inner cavities 34 and 83, but in other embodiments, the side walls 46 and 82, and the cavities 34 and 83, can be straight or not tapered. Furthermore, in some embodiments, the cavities 34 and 83 could be omitted and the cooling elements 30 and 66 can be formed of suitable materials other than plastic, including metals such as aluminum and copper. When linear cooling elements 30 and 66 are employed, the outer container 18 can be rectangular or have rectangular portions.

Figure 25:
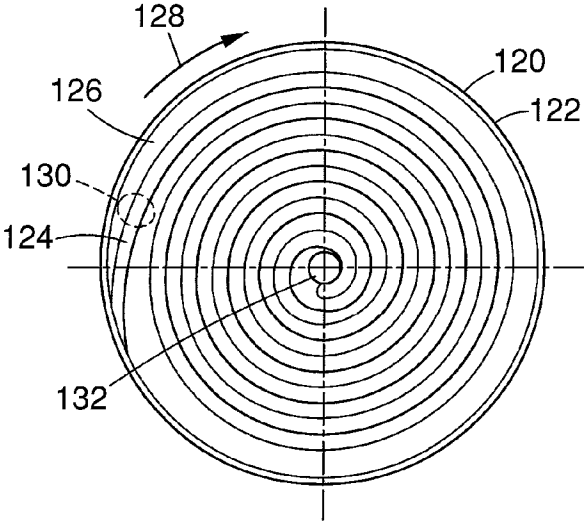
FIG. 25 is a schematic cross sectional view of the beverage cooling device of FIG. 24.
Figure 24:
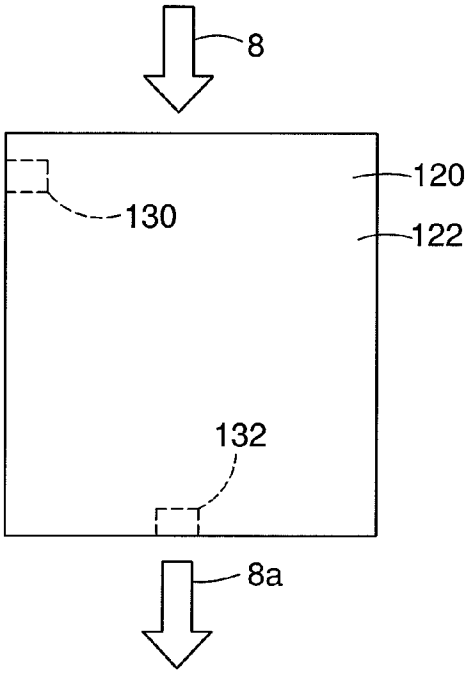
FIG. 24 is a side schematic view of yet another embodiment of a beverage cooling device.

Referring to FIGS. 24 and 25, fluid, liquid, beverage or heat exchange or cooling device 120 is another embodiment in the present invention in which hot fluid or liquid 8, for example a beverage such as coffee, can be poured into the top of a container 122. The container 122 can include a spiral cooling channel 126 formed between the coils of a spiral cooling element or tube 124, which can contain cooling media 36, and a cooling insert 38. The hot liquid 8 can enter the spiral cooling channel 26 through an inlet 130 and travel through the cooling channel 126 radially inwardly and downwardly by gravity in the direction of arrow 128 for cooling. The cooled liquid 8*a* exits out and flows through the bottom outlet 132. In some embodiments, the liquid 8 can travel through the spiral tube 124 and the cooling media 36 can be positioned in the spiral channel 126 surrounding the tube 124. In some embodiments, the spiral cooling channel 126 can be formed by or between a base cooling portion that is nested with an insert cooling portion. The of cooling channel 126 can be about 7 feet long, and about 0.05 to 0.10 inches wide, such as about 0.06 to 0.07 inches, and can be about 2 to 4½ inches high.

Figure 28:
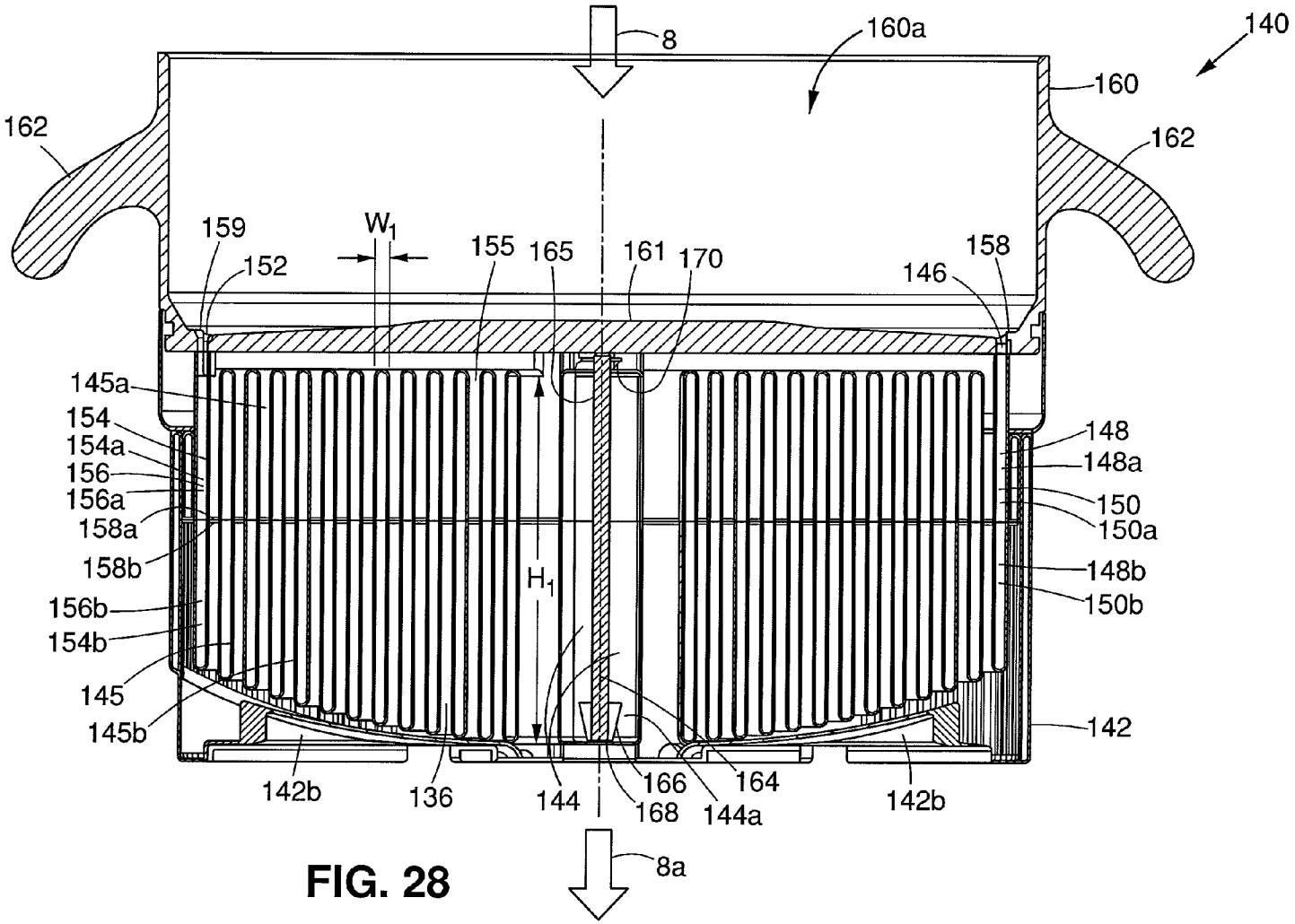
FIG. 28 is a side sectional view of FIG. 27 taken along lines 28-28.
Figure 29:
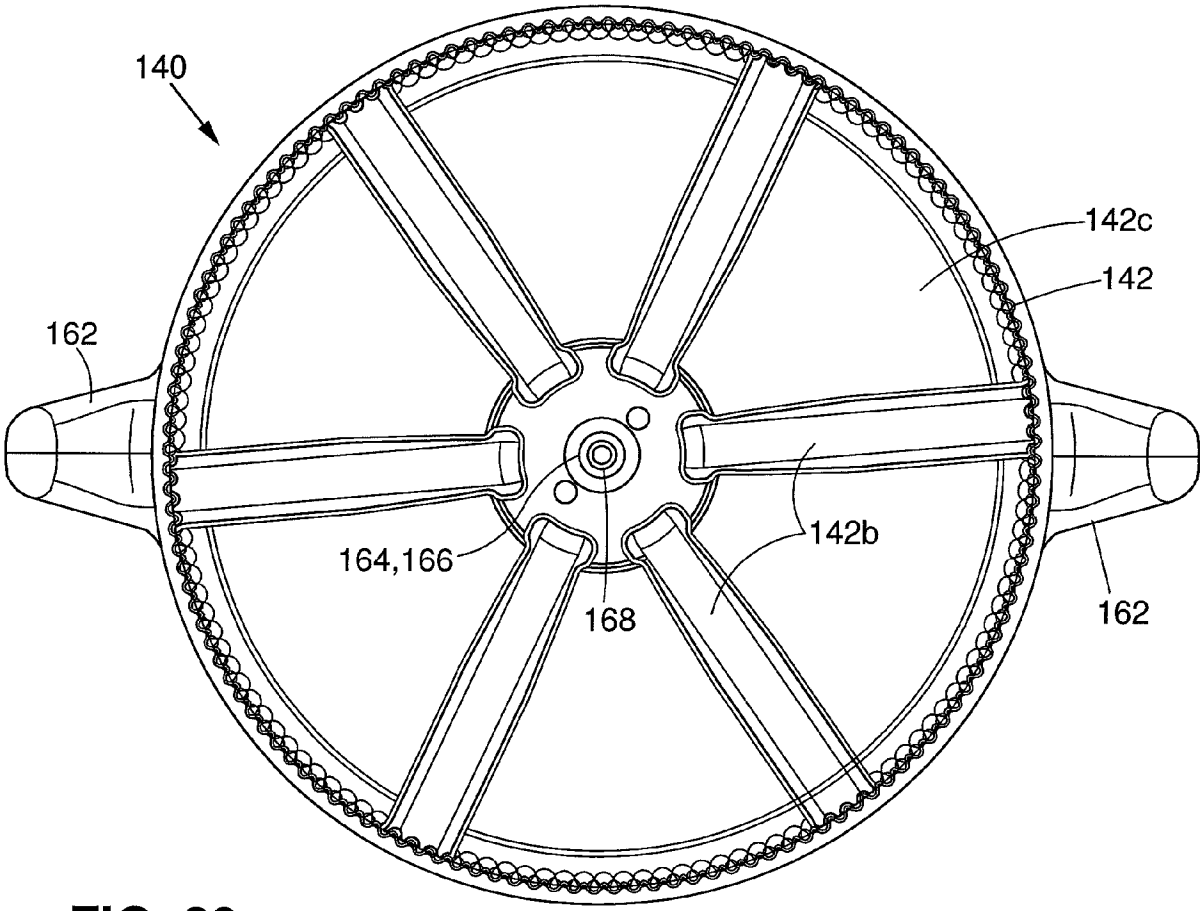
FIG. 29 is a bottom view of the beverage cooling device of FIG. 26.

Referring to FIGS. 26-29, fluid, liquid or beverage heat exchange or cooling device 140 is another embodiment in the present invention. Cooling device 140 can include a generally round lower or base container 142 having a bottom 142*c* with a series of spaced apart radially extending structural ribs 124*b*, which are sloped in the radially inward direction. A generally round heat exchange or cooling assembly 145 can be positioned within the interior 142*a* of the base container 142. A generally round upper container or reservoir 160 can be positioned above the cooling assembly 145. The upper reservoir 160 can include handles 162 for carrying the cooling device 140 and can have an interior 160*a* into which hot fluid, liquid or beverage 8, such as coffee can be poured. The interior 160*a* can have a bottom 161 that is sloped in the radially outward direction for directing liquid 8 to the outer periphery of the bottom 161. Two reservoir outlets 158 and 159 can be positioned at the outer periphery of the bottom 161, on opposite sides. The cooling assembly 145 can have two spiral or helical cooling channels 148 and 154 with radially outward inlets 146 and 152 fitted into the reservoir outlets 158 and 159, through which the hot liquid 8 can flow within the respective interiors 150 and 156 to be cooled therein. The cooling channels 148 and 154 can continuously spiral laterally radially inwardly towards the center of the cooling assembly 145 and terminate at two respective channel outlets 144. The spirals of the cooling channels 148 and 154 can have coils that are laterally adjacent to each other in alternating fashion. The bottom of the cooling channels 148 and 154 can slope downwardly moving radially inward, as can be seen in FIG. 28, so that the liquid 8 can flow radially inward from the inlets 146 and 152 to the outlets 144, by gravity. As a result, the top of the cooling channels 148 and 154 can extend radially inwardly along a horizontal or lateral plane and the bottom of the cooling channels 148 and 154 can slope downwardly, which can increase the cross sectional height of the cooling channels 148 and 154 moving radially inwardly. This can provide increased cooling capacity moving inwardly.

The interior 142*a* of base container 142 and two spiral cavities or spaces 155 between opposing side walls of the cooling channels 148 and 154, can be filled with cooling media 36, which can be similar to that described for cooling device 10, and can be water which freezes at about 32° F. As a result, both sides of most of the cooling channels 148 and 154 can be in contact with cooling media 136 that is within spiral spaces 155. Spiral conductive inserts can be positioned within spiral spaces 155. Consequently, as liquid 8 flows radially inwardly within cooling channels 148 and 154, the liquid 8 is cooled from opposite sides by the cooling media 36 while flowing until reaching outlets 144. The outlets 144 of the cooling channels 148 and 154 can empty into an outlet chamber 144*a* having an outlet opening 168 at the bottom for discharging cooled liquid 8*a*. The outlet opening 168 can be controlled by a valve 164 having a valve member 166 for opening and closing the outlet opening 168. The valve member 166 can be positioned on the end of a valve rod 165. The valve rod 165 can be connected to a heat activated valve control member 170 which can be thermostat controlled or can be a bimetal member. The temperature of the cooled liquid 8*a* within the outlet chamber 144*a* when at a predetermined level, can activate the valve control member 170 to open the valve 164, and allow liquid 8*a* to discharge from outlet opening 168. The valve 164 can be preset to maintain a flow rate of liquid 8 that results in obtaining cooled liquid 8*a* at a temperature in a predetermined range. Using two cooling channels 148 and 154 instead of a single cooling channel can cool the liquid 8 at a faster speed.

Figure 26:
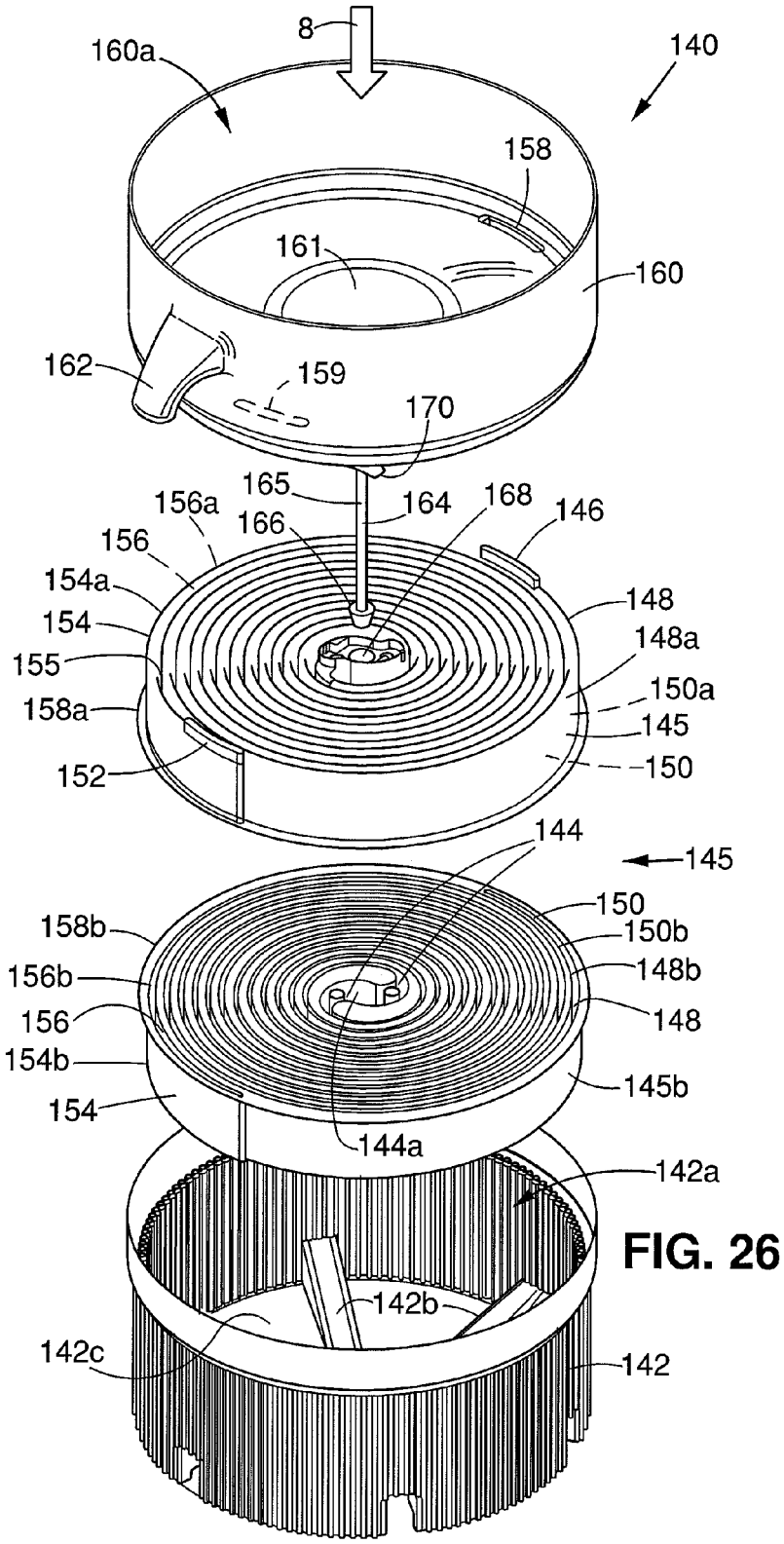
FIG. 26 is an exploded view of another embodiment of a beverage cooling device.
Figure 27:
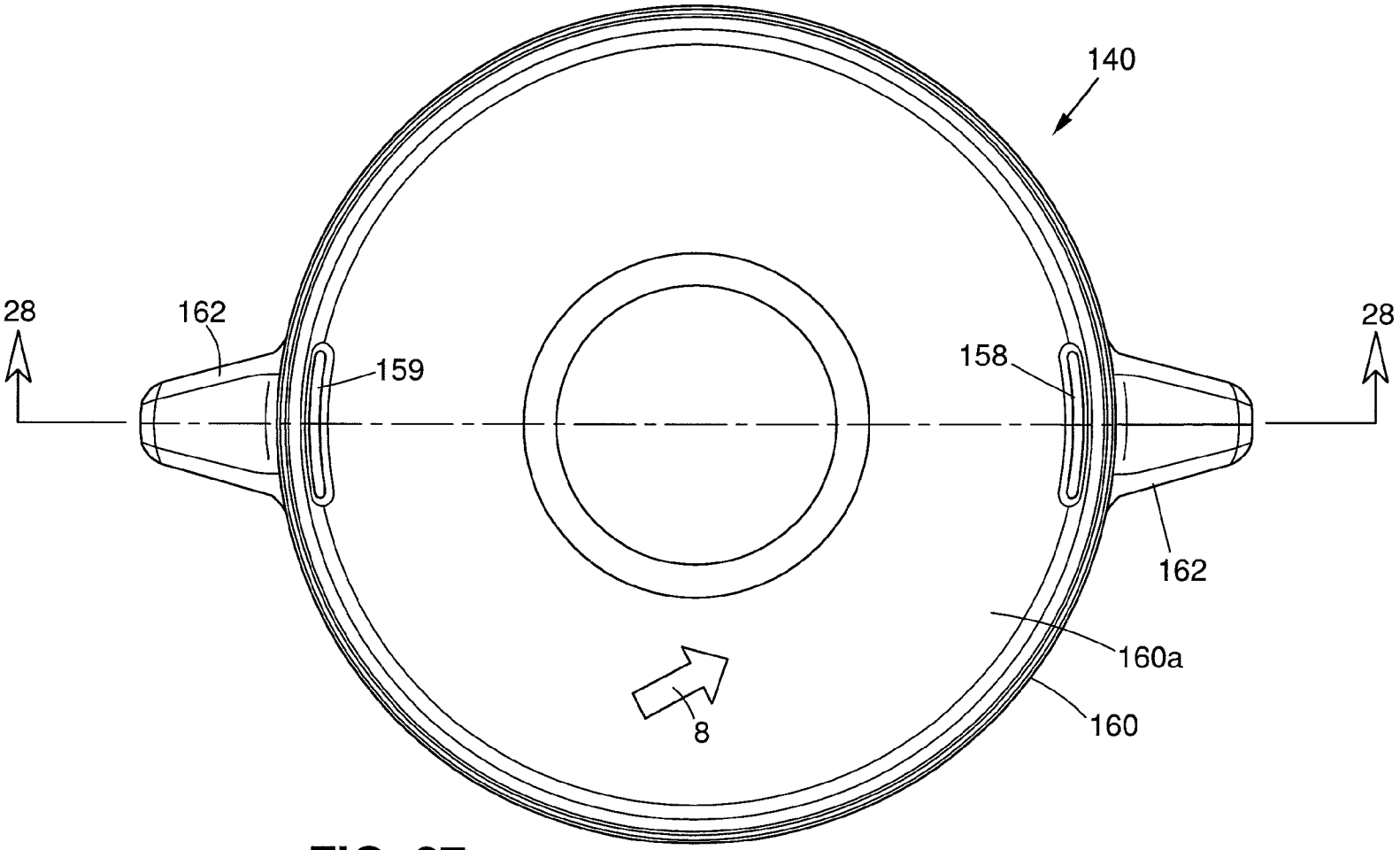
FIG. 27 is a top view of the beverage cooling device of FIG. 26.

Referring to FIGS. 26 and 28, the cooling assembly 145 can have an upper half or portion 145*a*, and lower half or portion 145*b*, which are joined together to form cooling channels 148 and 154. The upper portion 145*a* can have an upper channel half or portion 148*a* of one cooling channel 148 with its upper interior half or portion 150*a* of the interior 150, and the upper channel half or portion 154*a* of the other cooling channel 154 with its upper interior half or portion 156*a* of the interior 156. The lower portion 145*b* can have a lower channel half or portion 148*b* of cooling channel 148 with its lower interior half or portion 150*b* of the interior 150, and the lower channel half or portion 154*b* of the other cooling channel 154 with its lower interior half or portion 156*b* of the interior 156. The two portions 145*a* and 145*b* can be joined together and sealed along mating rims or seam portions 158*a* and 158*b*, to form the cooling channels 148 and 154. The cooling channels 148 and 154 can have rounded top and bottom walls, but can be considered to have interiors 150 and 156 with generally rectangular cross sectional areas, which can have a height $H_1$ to width $W_1$ ratio that starts at about 23:1 at the inlets 146 and 152, and gradually increases to about 30:1 at the outlets 144. The width $W_1$ of the interiors 150 and 156, and the spiral spaces 155 therebetween can be constant, but the height $H_1$ can increase in the downward direction moving radially inward. While the liquid 8 is cooled, the cooling media 36 when water, can be a phase change material that can change phase from a solid to at least a partial liquid or liquid, as the liquid 8 to be cooled heats the cooling media 36. The width of the spiral spaces 155 between the cooling channels 148 and 154 can be made to contain an amount or thickness of cooling media 36 such that the latent heat of fusion of the cooling media 36 or phase change material in thermal contact with the cooling channels 148 and 154, is at least approximately equal to the sensible energy to be removed from the liquid 8 to be cooled. The cooling assembly 145 can be molded from a plastic such as high density polyethylene, but in some embodiments, can be made of other suitable materials such as metals, including aluminum and copper. Although the cooling channels 148 and 154 have been shown to have inlets 145 and 152 on opposite sides, in some embodiments the inlets 146 and 152 can be near or adjacent to each other. In some embodiments, one cooling channel or more than two cooling channels can be employed. Additionally, in some embodiments, the height of the cooling channels can be constant, but can also be formed with a downward slope moving radially inward.

While this invention has been particularly shown and described with references to example embodiments thereof, it will be understood by those skilled in the art that various changes in form and details may be made therein without departing from the scope of the invention encompassed by the appended claims.

Although the present invention has been described for cooling fluids such as beverages, it is understood that in some embodiments, the fluids can be gasses. In addition, if desired, a refrigerator can be connected to the present invention for cooling the cooling channels. In some embodiments, the channels can be heated instead of cooled, for heating cold liquids. Various features of the embodiments described can be combined together or omitted. The outer containers, reservoirs, cooling elements and cooling channels can have other suitable shapes than those shown, and can include other curves, polygons, straight lines or combinations thereof. Although orientational terms have been given such as top, bottom, upper, lower etc., other orientations can occur.

What is claimed is:

1. A beverage preparation fluid cooling apparatus comprising:

a liquid container into which a beverage liquid is capable of being poured and cooled in a batch;

a first cooling portion having a first series of generally annular concentric upright cooling element partitions with first cooling surfaces positioned within the liquid container; and a second cooling portion having a second series of generally annular concentric upright cooling element partitions with second cooling surfaces removably nested together with the first cooling portion where the first and second series of cooling element partitions are positioned concentrically relative to each other in alternating spaced apart fashion within the liquid container forming concentric annular cooling channels therebetween for cooling the beverage liquid introduced therein, the annular cooling channels being connected to each other by passages extending through selected wall locations of the cooling elements which are generally aligned with a spout to facilitate pouring from the container when tilted.

2. A fluid cooling apparatus comprising:

a first cooling portion having a first series of cooling elements with first cooling surfaces; and a second cooling portion having a second series of cooling elements with second cooling surfaces, the second cooling portion being removably nested together with the first cooling portion such that the first and second cooling surfaces of the respective first and second series of cooling elements are positioned adjacent to each other with gaps therebetween to form cooling cavities for cooling a liquid fluid introduced into the cooling cavities, the first and second series of cooling elements comprising partitions that are spaced apart from each other by the cooling cavities, which form cooling channels of uniform width between the partitions, the first and second series of cooling elements being positioned within a liquid container into which the liquid is capable of being poured and cooled in a batch, the first cooling portion being a bottom cooling portion and the second cooling portion being an upper cooling portion that is nested downwardly into the bottom cooling portion, such that the cooling portions are generally upright, the partitions of the first and second series of cooling elements being generally circular and positioned concentrically relative to each other in alternating spaced apart fashion forming the cooling channels as concentric annular cooling channels therebetween, the annular cooling channels being connected to each other by passages extending through selected wall locations of the cooling elements which are generally aligned with a spout to facilitate pouring from the container when tilted, the upper cooling portion including a top plate formed of thermally conductive material over which the liquid is poured, the top plate being configured for directing the liquid into an outer annular cooling channel, the top plate being formed of aluminum and secured over the first series of cooling elements with an elongate thermally conductive rod that extends through a center chamber containing cooling media, thereby conducting heat through the cooling media in the center chamber.

3. A beverage preparation fluid cooling apparatus comprising:

a first cooling portion having a first series of cooling elements with first cooling surfaces; and a second cooling portion having a second series of cooling elements with second cooling surfaces, the second cooling portion being removably nested together with the first cooling portion such that the first and second cooling surfaces of the respective first and second series of cooling elements are positioned adjacent to each other with gaps therebetween to form cooling cavities for cooling a beverage liquid introduced into the cooling cavities, the first and second series of cooling elements comprising partitions that are spaced apart from each other by the cooling cavities, which form cooling channels of uniform width between the partitions, the first and second series of cooling elements being positioned within a liquid container into which the beverage liquid is capable of being poured and cooled in a batch, the first cooling portion being a bottom cooling portion and the second cooling portion being an upper cooling portion that is nested downwardly into the bottom cooling portion, such that the cooling portions are generally upright, the partitions of the first and second series of cooling elements being generally circular and positioned concentrically relative to each other in alternating spaced apart fashion forming the cooling channels as concentric annular cooling channels therebetween, the annular cooling channels being connected to each other by passages extending through selected wall locations of the cooling elements which are generally aligned with a spout to facilitate pouring from the container when tilted.

4. The cooling apparatus of claim 1 in which the partitions of the first and second series of cooling elements are formed of plastic and are hollow, containing a cooling media therein and a thermally conductive metallic insert for conducting heat through the cooling media.

5. The cooling apparatus of claim 3 in which the partitions of the first and second series of cooling elements contain cooling media therein.

6. The cooling apparatus of claim 5 in which the cooling media comprises a substance that is capable of changing phase from a solid to at least a partial liquid.

7. The cooling apparatus of claim 6 in which the cooling media comprises water.

8. The cooling apparatus of claim 5 in which the partitions of the first and second series of cooling elements are hollow, containing the cooling media therein and a thermally conductive insert for conducting heat through the cooling media.

9. The cooling apparatus of claim 8 in which the thermally conductive insert comprises an aluminum sheet.

10. The cooling apparatus of claim 3 in which the partitions of the first and second series of cooling elements each have a distal end and are formed with tapered side walls that narrow moving toward the distal end, whereby the first and second series of cooling elements are nested from opposite directions, and the tapered side walls of the adjacent partitions of the first and second series of cooling elements match each other to form the cooling channels having parallel side walls.

11. The cooling apparatus of claim 10 in which the partitions of the first and second series of cooling elements are molded from plastic.

12. The cooling apparatus of claim 3 in which the upper cooling portion includes a top plate over which liquid is poured, the top plate being configured for directing the liquid into an outer annular cooling channel.

13. The cooling apparatus of claim 12 in which the top plate is formed of thermally conductive metal.

14. The cooling apparatus of claim 13 in which the top plate is formed of aluminum and is secured over the first series of cooling elements with an elongate thermally conductive rod that extends through a center chamber containing cooling media, thereby conducting heat through the cooling media in the center chamber.

15. The cooling apparatus of claim 9 in which the cooling media contained within the hollow partitions of the cooling elements has a thickness between side walls of the partitions such that the energy contained in the latent heat of fusion approximates a sensible energy change in the beverage liquid to be cooled.

16. The cooling apparatus of claim 15 in which the width of the cooling channels ranges from about 0.05 to 0.10 inches.

* * * * *